US005160969A

United States Patent [19]

Mizuma et al.

[11] Patent Number: 5,160,969

[45] Date of Patent: Nov. 3, 1992

[54] IMAGE FORMING APPARATUS HAVING A SEPARATE BLACK DEVELOPER STORED FOR A COLOR IMAGE

[75] Inventors: Kenichi Mizuma; Hideya Furuta; Nobuo Kasahara; Noriyuki Kimura, all of Kawasaki; Shinju Nagatsuna, Tokyo; Mitsuru Mamizuka, Tokyo; Yoshihiro Sakai, Toyko; Kazunori Bannai, Tokyo; Kazushige Taguchi, Warabi; Yasunori Kawaishi, Narashino; Makoto Ohsaki, Yokohama; Tatsuo Hirono, Kawasaki, all of Japan

[73] Assignee: Ricoh Company, Ltd., Tokyo, Japan

[21] Appl. No.: 707,050

[22] Filed: May 29, 1991

Related U.S. Application Data

[63] Continuation-in-part of Ser. No. 542,887, Jan. 25, 1990, abandoned.

[30] Foreign Application Priority Data

| | | | |
|---|---|---|---|
| Jun. 26, 1989 | [JP] | Japan | 1-163313 |
| Dec. 26, 1989 | [JP] | Japan | 1-149486 |
| Jun. 19, 1990 | [JP] | Japan | 2-158807 |
| Jun. 26, 1990 | [JP] | Japan | 2-167930 |
| May 8, 1991 | [JP] | Japan | 3-131684 |

[51] Int. Cl.[5] ..... G03G 15/01

[52] U.S. Cl. ..... 355/326; 118/645; 355/245

[58] Field of Search ..... 355/245, 326, 327, 260; 118/653, 656, 645

[56] References Cited

U.S. PATENT DOCUMENTS

| | | | |
|---|---|---|---|
| 3,970,042 | 7/1976 | Rees | 355/326 X |
| 4,659,211 | 4/1987 | Oka | 118/657 X |
| 4,841,337 | 6/1989 | Hiratsuka et al. | 355/326 X |
| 4,884,096 | 11/1989 | Kusuda et al. | 355/326 X |
| 4,891,672 | 1/1990 | Takagi | 355/245 |
| 4,939,548 | 7/1990 | Yamada et al. | 355/245 |

FOREIGN PATENT DOCUMENTS

| | | | |
|---|---|---|---|
| 0254167 | 12/1985 | Japan | 355/326 |

*Primary Examiner*—A. T. Grimley
*Assistant Examiner*—Thu Dang
*Attorney, Agent, or Firm*—Oblon, Spivak, McClelland, Maier & Neustadt

[57] ABSTRACT

An image forming apparatus has a plurality of developing containers for developing an electrostatic latent image of a latent image carrier by toners having colors different from each other except for black; a black developing container for color for storing black toner for color and operated when the developed image on the latent image carrier every color is overlapped and transferred onto a transfer material to provide a color image; a black developing container for a monochromatic image for storing black toner for a monochromatic image and operated when the monochromatic image is obtained; and a device for arranging the respective developing containers such that the developing containers are opposite to the latent image carrier. The other image forming apparatuses are also shown.

11 Claims, 13 Drawing Sheets

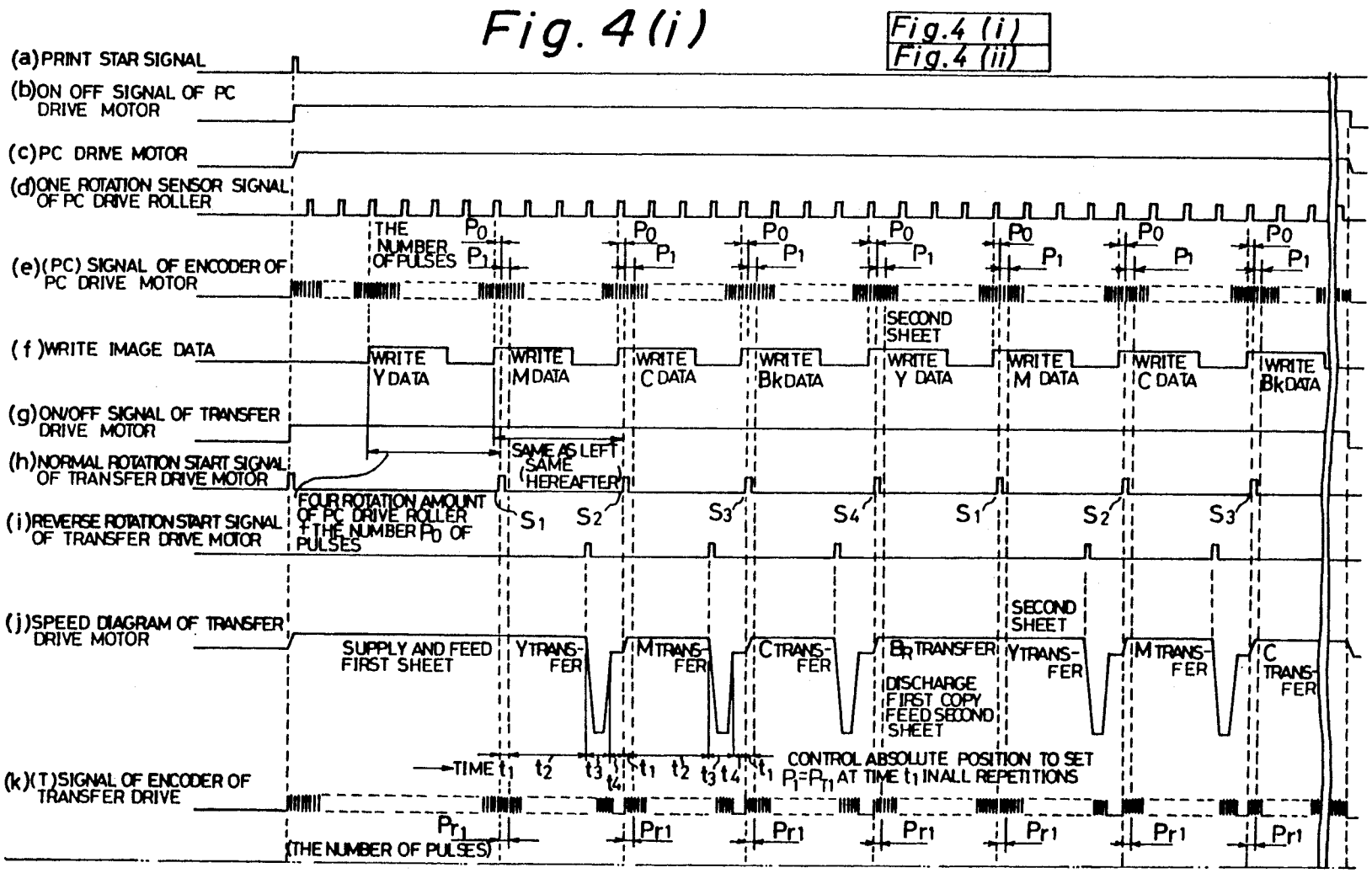
Fig. 4 (i)
Fig.4 (i)
Fig.4 (ii)
(a) PRINT STAR SIGNAL
(b) ON OFF SIGNAL OF PC DRIVE MOTOR
(c) PC DRIVE MOTOR
(d) ONE ROTATION SENSOR SIGNAL OF PC DRIVE ROLLER
(e) (PC) SIGNAL OF ENCODER OF PC DRIVE MOTOR
(f) WRITE IMAGE DATA
(g) ON/OFF SIGNAL OF TRANSFER DRIVE MOTOR
(h) NORMAL ROTATION START SIGNAL OF TRANSFER DRIVE MOTOR
(i) REVERSE ROTATION START SIGNAL OF TRANSFER DRIVE MOTOR
(j) SPEED DIAGRAM OF TRANSFER DRIVE MOTOR
(k) (T) SIGNAL OF ENCODER OF TRANSFER DRIVE
THE NUMBER OF PULSES
WRITE Y DATA
WRITE M DATA
WRITE C DATA
WRITE Bk DATA
SECOND SHEET
SAME AS LEFT (HEREAFTER)
FOUR ROTATION AMOUNT OF PC DRIVE ROLLER THE NUMBER Po OF PULSES
SUPPLY AND FEED FIRST SHEET
Y TRANSFER
M TRANSFER
C TRANSFER
Bk TRANSFER
DISCHARGE FIRST COPY FEED SECOND SHEET
CONTROL ABSOLUTE POSITION TO SET P1=Pr1 AT TIME t1 IN ALL REPETITIONS
TIME t1 t2 t3 t4
THE NUMBER OF PULSES
Po
P1
Pr1
S1
S2
S3
S4

Fig. 4 (ii)

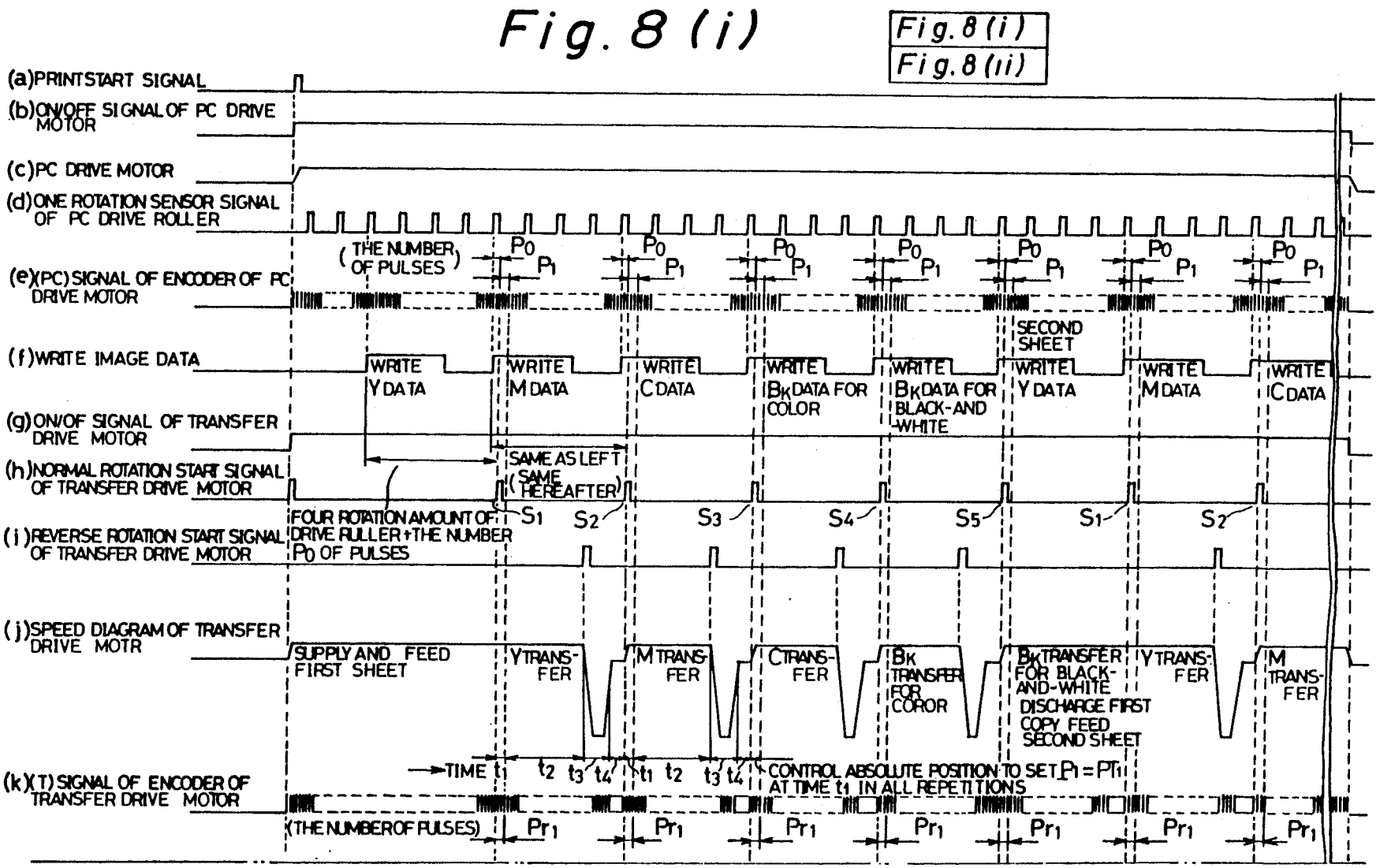
Fig. 8 (i)
Fig. 8 (ii)
(a) PRINT START SIGNAL
(b) ON/OFF SIGNAL OF PC DRIVE MOTOR
(c) PC DRIVE MOTOR
(d) ONE ROTATION SENSOR SIGNAL OF PC DRIVE ROLLER
(e) (PC) SIGNAL OF ENCODER OF PC DRIVE MOTOR
(f) WRITE IMAGE DATA
(g) ON/OF SIGNAL OF TRANSFER DRIVE MOTOR
(h) NORMAL ROTATION START SIGNAL OF TRANSFER DRIVE MOTOR
(i) REVERSE ROTATION START SIGNAL OF TRANSFER DRIVE MOTOR
(j) SPEED DIAGRAM OF TRANSFER DRIVE MOTR
(k) (T) SIGNAL OF ENCODER OF TRANSFER DRIVE MOTOR
(THE NUMBER OF PULSES)
P0
P1
WRITE Y DATA
WRITE M DATA
WRITE C DATA
WRITE BK DATA FOR COLOR
WRITE BK DATA FOR BLACK-AND-WHITE
WRITE Y DATA
WRITE M DATA
WRITE C DATA
SECOND SHEET
SAME AS LEFT (SAME THEREAFTER)
S1
S2
S3
S4
S5
FOUR ROTATION AMOUNT OF DRIVE ROLLER + THE NUMBER P0 OF PULSES
SUPPLY AND FEED FIRST SHEET
Y TRANSFER
M TRANSFER
C TRANSFER
BK TRANSFER FOR COLOR
BK TRANSFER FOR BLACK-AND-WHITE
DISCHARGE FIRST COPY FEED SECOND SHEET
Y TRANSFER
M TRANSFER
TIME t1 t2 t3 t4
CONTROL ABSOLUTE POSITION TO SET P1 = Pr1 AT TIME t1 IN ALL REPETITIONS
Pr1

Fig. 8 (ii)

IMAGE FORMING APPARATUS HAVING A SEPARATE BLACK DEVELOPER STORED FOR A COLOR IMAGE

CROSS REFERENCE TO RELATED APPLICATION

The present application is a continuous-in-part of application Ser. No. 542,887 filed on Jun. 25, 1990, which is now abandoned.

BACKGROUND OF THE INVENTION

1. Field of the Invention

The present invention relates to a color image processing system for processing a black and white image. More particularly, the present invention relates to a color image processing apparatus used in a color electrophotographic device, a color facsimile, a word processor, a personal computer, a printer, etc. The present invention also relates to an image forming apparatus for selectively providing a color image and a monochromatic image.

2. Description of the Related Art

Recently, there have been requirements of copying machines which can perform copying processing of both a black-and-white image and a color image in accordance with coloring of documents. To enable this color copying processing, many color copying machines are provided with a developing container having a black developer and a plurality of developing containers for respectively storing yellow, magenta and cyan developers as shown in Japanese Patent Publication (KOKOKU) No. 59-26954, Japanese Patent Application Laying Open (KOKAI) No. 62-180379, etc.

In the above color copying machines, an image is made in a black-and-white copying mode by using only the black developing container. In a color copying mode, respective decomposed images are overlapped with each other by using the respective yellow, magenta and cyan developing containers and the black developing container used in the above black-and-white copying mode in accordance with necessity, thereby performing the color copying processing.

In general, with respect to the quality of the black-and-white image in the black-and-white copying mode, it is most preferable to provide an image having less luster and no gloss in consideration of fatigue of eyes or to make the image easy to read. Therefore, the copying machines use the black developer adjusted such that the glossiness of the image is restrained as much as possible after a fixing processing in a combination of the fixing and developing processings. Namely, the copying machines use a black developer having a high melting temperature.

In contrast to this, with respect to the quality of the color image in the color copying mode, the image is bright and has a good appearance when the glossiness of the image is higher. Therefore, it is preferable to set the glossiness of the image to be high as much as possible after the fixing processing thereof. Accordingly, the black developer used in the color image processing has a low melting temperature.

To satisfy the above two conditions with respect to the black developer by a single developer, the melting temperature of the black developer is adjusted to provide an intermediate image quality with respect to the black-and-white image and the color image in the general technique as shown in Japanese Patent Application Laying Open (KOKAI) No. 62-180379.

In the Japanese Patent Publication (KOKOKU) No. 59-26954, a single black developer is commonly used to process both the black-and-white image and the color image. In this publication, a means for selectively moving a developing container is disposed to develop each color image in a single developing position so as to perform a so-called revolver development. The developing container of the black developer is separated from the other three developing containers to reduce a time for switching the respective developing containers in the revolver development. Thus, the developing container of the black developer is set in a developing position different from the developing positions of the developing containers of the other three developers.

In another proposed general technique of the copying machine, a fixing means is constructed by a plurality of fixing rollers. A surface of each of the fixing rollers is coated with e.g., Teflon-based resin, silicon rubber, etc. The glossiness of the image is restrained by the fixing rollers coated with the Teflon-based resin through the fixing processing of the image, which is suitable for the black-and-white copy image. The image is glossy by the fixing rollers coated with the silicon rubber through the fixing processing of the image, which is suitable for the color copy image. Such rollers coated with the Teflon-based resin, the silicon rubber, etc. are selectively used to perform a copying processing suitable for the black-and-white image or the color image.

However, the respective processed qualities of the black-and-white image and the color image are not completely satisfied in the above technique in which the melting temperature of the black developer is adjusted to obtain the intermediate image quality with respect to the black-and-white image and the color image. In other words, when the above black developer is used, the glossiness of the black-and-white image cannot be restrained to a minimum value and it is impossible to sufficiently prevent the fatigue of eyes and secure the image easy to read. In the case of the color image, it is impossible to increase the glossiness of the image until the image is bright and has a good appearance.

In the arrangement in which the developing container of the black developer is separated from the developing containers of the other colors, the developer of the separated black developing container is also used in the color image processing, it is impossible to perform the yellow, magenta, cyan and black developing processings in the same position of a photosensitive body in a series of color image processings. Therefore, all the developing conditions with respect to the respective colors is not constant at any time so that a control operation for switching the respective developing containers, etc. are complicated and there is a fear that a shift in color image is caused.

In the above technique, the image processing suitable for the black-and-white image and the color image is performed by selectively using the fixing rollers having surfaces coated with the Teflon-based resin or the silicon rubber. In such a technique, it is possible to sufficiently solve the above disadvantages when the entire image to be fixed is constructed by the black-and-white copy image or the color copy image composed of a picture, etc. However, for example, the copying machine in this technique cannot cope with an original having a character portion and a color picture portion mixed with each other so that it is impossible to secure the satisfied quality of the image as in the above-mentioned case.

In other word, Recently, an image forming apparatus such as a copying machine, a facsimile, a printer, etc. has been widely used in an office, etc. In particular, there are increasing requirements for a copying machine for providing a monochromatic copy and a full color copy in according with coloring of documents.

Therefore, the image forming apparatus is provided with a plurality of developing containers for respectively storing yellow, magenta, cyan and black developers. At the time of the monochromatic copy, the black developing container is operated to obtain a monochromatic image. At the time of the color copy, the yellow, magenta, cyan and black developing containers are operated such that yellow, magenta and cyan developed images are respectively overlapped and transferred onto the same transfer material so as to obtain a color image. In a digital copying machine, yellow, magenta, cyan and black developed images are respectively overlapped and transferred onto the same transfer material.

With respect to the quality of a copy image obtained by a monochromatic copying machine for business, it is preferable to provide an image having less luster and no gloss in consideration of fatigue of eyes or the image easy to read. To satisfy such requirements, it is desirable to use black toner for reducing the glossiness of a fixed image as much as possible.

In contrast to this, with respect to the quality of a full color copy image, the image is bright and has a good appearance when the glossiness of the image is higher. Therefore, it is desirable to use toner for increasing the glossiness of a fixed image to a certain extent.

Therefore, for example, as shown in Japanese Patent Application Laying Open (KOKAI) No. 62-180379, a melting temperature of the black toner is set to be higher than that of color toner so as to provide an intermediate glossiness for the overlapped images. However, in this structure, it is difficult to respectively satisfy qualities of both the monochromatic and color images.

As mentioned above, in the case of the monochromatic copy, it is desirable to provide an image having less luster and characters and diagrams are mainly drawn in an original, etc. Accordingly, it is desirable to provide a sharp image clearly showing edges. Such an image is called an image having an edge effect in the following description. In the case of the full color copy, an image having a large area and an intermediate color tone is copied in many cases so that it is desirable to provide a smooth and soft image. Such an image is an image provided by restraining the edge effect.

Further, in the digital copying machine, there is no problem with respect to an image having characters and diagrams since the image is formed by dots. However, when the image has a large area, image quality is easily reduced by dispersions in shape and position of dots since this image is formed by gathering these dots. In such a case, it is preferable to use a developing system for restraining the edge effect.

When the monochromatic image is formed, an original is mainly constructed by characters and diagrams so that it is desirable to provide an image having less luster in consideration of fatigue of eyes and the image easy to read. Further, frequency in formation of the monochromatic image is high in comparison with a color image so that it is necessary to form the monochromatic image at a high speed.

In contrast to this, when the color image is formed, it is desirable to provide a clear image having a high glossiness in consideration of a good appearance. Further, since the number of developing containers is increased, it is necessary to make the respective developing containers compact such that no image forming apparatus is large-sized.

U.S. Pat. No. 4,891,672 shows a monochromatic copying machine constructed such that images having single colors are respectively formed by developing devices. However, this patent does not shown a black developing container for a full color. If the black developing container for a full color is disposed in this monochromatic copying machine, the black developing container for a full color completely has the same construction as a black developing device and has no technical meaning.

SUMMARY OF THE INVENTION

It is therefore a first object of the present invention to provide an image forming apparatus in which a sharp image having an edge effect can be obtained in the case of a monochromatic image mainly constructed by characters, diagrams, etc. and a clear image restraining the edge effect and having a good appearance can be obtained in the case of a color image.

A second object of the present invention is to provide an image forming apparatus for selectively obtaining color and monochromatic images in which the monochromatic image can be formed at a high speed and the entire image forming apparatus can be made compact.

In accordance with a first structure of the present invention, the above objects can be achieved by an image forming apparatus comprising a plurality of developing containers for developing an electrostatic latent image of a latent image carrier by toners having colors different from each other except for black; a black developing container for color for storing black toner for color and operated when the developed image on the latent image carrier every color is overlapped and transferred onto a transfer material to provide a color image; a black developing container for a monochromatic image for storing black toner for a monochromatic image and operated when the monochromatic image is obtained; and means for arranging the respective developing containers such that the developing containers are opposite to said latent image carrier.

In accordance with a second structure of the present invention, the above objects can be achieved by an image forming apparatus comprising a plurality of developing containers for developing an electrostatic latent image of a latent image carrier by toners having colors different from each other except for black; a black developing container for color for storing a black developer for color and operated when the developed image on the latent image carrier every color is overlapped and transferred onto a transfer material to provide a color image; a black developing container for a monochromatic image for storing a black developer for a monochromatic image and operated when the monochromatic image is obtained; and means for arranging the respective developing containers such that the developing containers are opposite to said latent image carrier; a melting temperature of the black developer for color being set to be lower than that of the black developer for a monochromatic image.

In accordance with a third structure of the present invention, the above objects can be achieved by an image forming apparatus comprising a plurality of developing containers for developing an electrostatic latent image of a latent image carrier by toners having colors different from each other except for black; a black developing container for color for storing black toner for color to increase glossiness of the image and operated when the developed image on the latent image carrier every color is overlapped and transferred onto a transfer material to provide a color image; a black developing container for a monochromatic image for storing black toner for a monochromatic image to reduce glossiness of the image and operated when the monochromatic image is obtained; and means for arranging the respective developing containers such that the developing containers are opposite to said latent image carrier.

In accordance with a fourth structure of the present invention, the above objects can be achieved by an image forming apparatus comprising a plurality of developing containers for developing an electrostatic latent image of a latent image carrier by toners having colors different from each other except for black; a black developing container for color for storing a black developer for color composed for one component and operated when the developed image on the latent image carrier every color is overlapped and transferred onto a transfer material to provide a color image; a black developing container for a monochromatic image for storing a black developer for a monochromatic image composed of two components and operated when the monochromatic image is obtained; and means for arranging the respective developing containers such that the developing containers are opposite to said latent image carrier.

In accordance with a fifth structure of the present invention, the above objects can be achieved by an image forming apparatus comprising a plurality of developing containers for developing an electrostatic latent image of a latent image carrier by toners having colors different from each other except for black; a black developing container for color for storing black toner for color and operated when the developed image on the latent image carrier every color is overlapped and transferred onto a transfer material to provide a color image; a black developing container for a monochromatic image for storing black toner for a monochromatic image and operated when the monochromatic image is obtained; and means for arranging the respective developing containers such that the developing containers are opposite to said latent image carrier; the black developing container for a monochromatic image providing a high edge effect in comparison with the other developing containers for color.

In accordance with the above structures, a sharp image having an edge effect can be obtained in the case of a monochromatic image mainly constructed by characters, diagrams, etc. and a clear image restraining the edge effect and having a good appearance can be obtained in the case of a color image.

Further, in the image forming apparatus for selectively obtaining the color and monochromatic images, the monochromatic image can be formed at a high speed and the entire image forming apparatus can be made compact.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a color image processing apparatus and an image forming apparatus in the present invention will next be described in detail with reference to the accompanying drawings.

Figure 1:
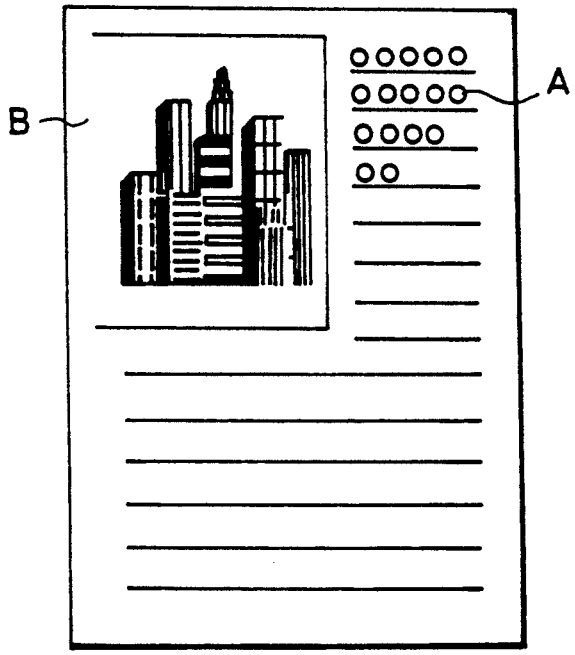
FIG. 1 is an explanatory view showing an example of an arrangement of character and picture portions mixed with each other in an original to point out problems in a general color image processing apparatus.

FIG. 1 shows an original having a character portion A and a color picture portion B mixed with each other. A general apparatus for processing a color image cannot cope with such an original so that it is impossible to secure a satisfied quality of the image.

Figure 2:
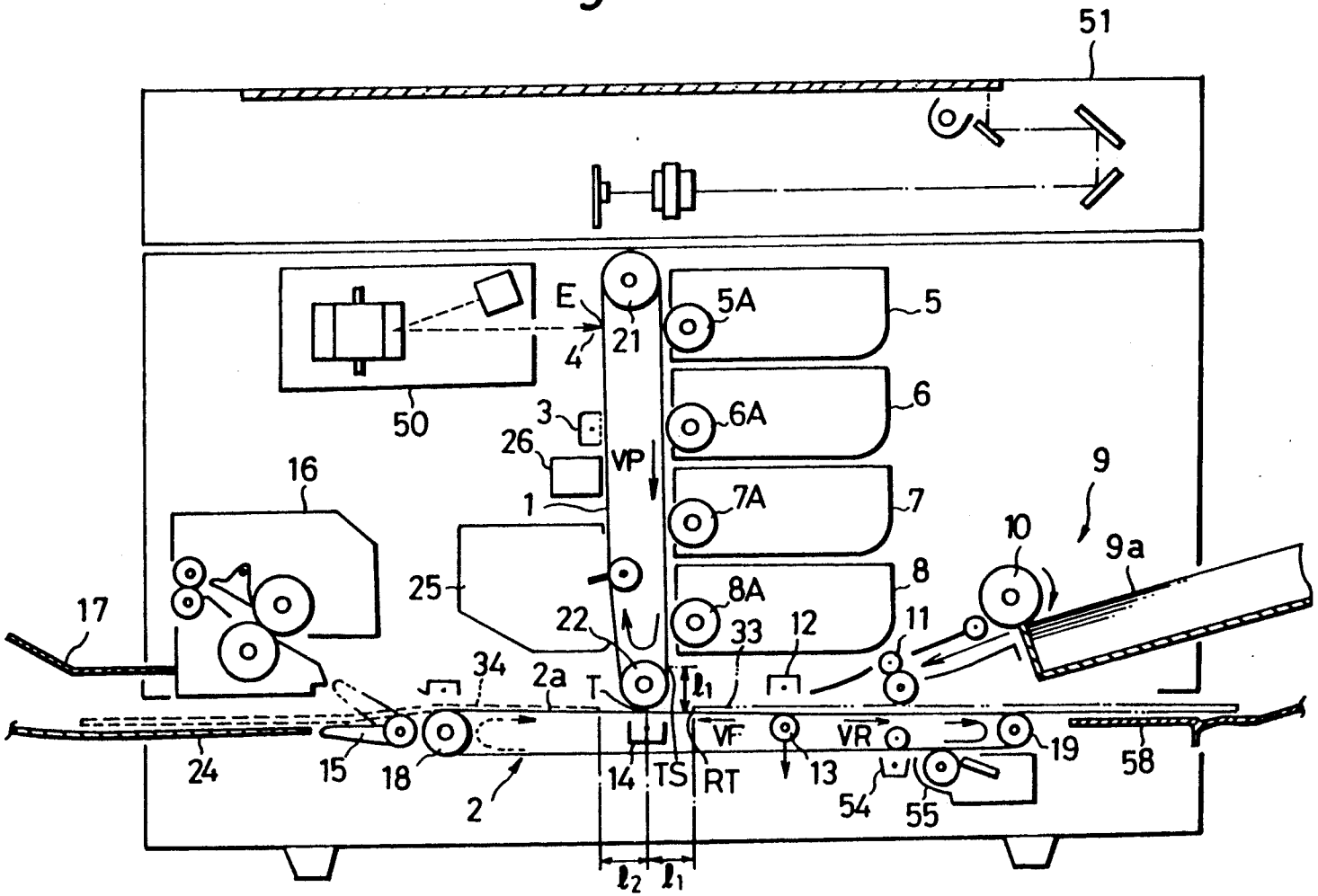
FIG. 2 is a view schematically showing the construction of a general image forming apparatus.

FIG. 2 shows an example of a general copying machine for providing a full color copy.

In this figure, a photosensitive body 1 in the shape of an endless belt is provided as one constructional example of a carrier of a latent image. The photosensitive body 1 is wound around two rollers 21 and 22 therebetween and is arranged in a longitudinal direction thereof in this image forming apparatus. The photosensitive body 1 is moved and rotated in an arrow direction and has a surface uniformly charged by a charger 3. An optical writing operation with respect to this charged surface of the photosensitive body 1 is performed by an optical write device 50 in a recording section 4 so that an electrostatic latent image is formed on the surface of the photosensitive body 1. In the image forming apparatus of a type in which an image exposing operation is performed, the electrostatic latent image is formed by forming and projecting an image of an original in such a recording section 4.

Developing containers 5 to 8 are respectively opposite to the photosensitive body 1 and are arranged in the moving direction of the photosensitive body 1. These developing containers respectively store developers having colors different from each other such as yellow, magenta, cyan and black toners. Every time when a developing operation is performed with respect to each of the color toners, the electrostatic latent image formed in advance on the photosensitive body is developed as a toner image every color.

A sheet of transfer paper as one example of a transfer material is fed by a paper supplying roller 10 from a paper supplying section 9 in an arrow direction. The sheet of transfer paper is conveyed toward a transfer belt 2 in a resist roller 11 at a predetermined timing.

This sheet of transfer paper is electrostatically adsorbed by a paper adsorbing charger 12 onto a flat belt portion 2a on the upper side of the transfer belt 2 moving and rotating in the direction of an arrow shown by a solid line. The sheet of transfer paper is conveyed leftward on the transfer belt in this adsorbed state. At this time, a developed image formed on the photosensitive body 1 with respect to a first color is transferred onto the sheet of transfer paper by a transfer corona charger 14. At this transfer time, a contact/separation switching roller 13 is raised so that a portion of the transfer belt on the side thereof opposite to the transfer corona charger 14 comes in contact with the photosensitive body 1.

After the transfer operation, the transfer paper is fed until a going terminal position shown by a broken line. Thereafter, the transfer belt 2 is moved and rotated in the direction shown by a broken line and opposite to the direction of the arrow shown by the solid line in a state in which the contact/separation switching roller 13 is lowered. Thus, the sheet of transfer paper is returned until a returning terminal position shown by a phantom line. In the following description, a normal rotary direction of the transfer belt 2 is the direction shown by the solid line and a reverse rotary direction of the transfer belt 2 is the direction shown by the broken line.

Next, the transfer belt 2 is again rotated in the normal direction. At this time, a developed image on the photosensitive body 1 with respect to a second color is transferred onto the sheet of transfer paper conveyed together with the transistor belt. In this case, the contact/separation switching roller 13 is raised. Thereafter, the above-mentioned operations are similarly performed and the transfer operation is performed four times at most. Thus, the developed toner images composed of four colors are overlapped with each other and are transferred onto the sheet of transfer paper. The black developing container 8 is also used in addition to the color developing containers 5 to 7 since a digital system for performing the optical writing operation is normally used. After all such transfer operations are completed, the sheet of transfer paper is guided onto the side of a fixing device 16 by a path switching member 15 switched to the position shown by a phantom line. The sheet of transfer paper is then fixed by a fixing section of the fixing device 16 and is discharged onto a tray 17, thereby obtaining a sheet of color copy paper. After the transfer operation, the surface of the photosensitive body 1 is cleaned by a cleaner 25 and the photosensitive body 1 is discharged by a discharge device 26. In FIG. 2, reference numeral 51 designates a device for reading an original.

With respect to the quality of a copy image obtained by the monochromatic copying maching for business, it is preferable to provide an image having less gloss and no luster in consideration of fatigue of eyes and the image easy to read. To satisfy such a requirement, black toner is used to reduce the glossiness of the image as much as possible after the fixing operation thereof in the normal monochromatic copying machine.

On the other hand, with respect to the quality of a full color image, it is preferable to provide an image having higher glossiness in consideration of brightness and appearance. To satisfy such a requirement, color toner is used to increase the glossiness of the image as much as possible after the fixing operation thereof.

In FIG. 2, when the black toner for improving the glossiness of the image after the fixing operation thereof is stored into a black developing container 8, an image having a preferable quality can be obtained in the case of the full color copy. However, when a monochromatic image (a so-called black-and-white image) is obtained by using only this black developing container 8, the monochromatic image has a high glossiness and a bad appearance. In contrast to this, when black toner for reducing the glossiness of the image is stored into this developing container, it is difficult to provide a brighter full color image when the full color copy is obtained at the next time.

Therefore, in Japanese Patent Application Laying Open (KOKAI) No. 62-180379, a melting temperature of the black toner is set to be higher than that of the color toner so as to provide an intermediate glossiness with respect to overlapped images. In this proposed apparatus, it is difficult to provide the monochromatic and color images having satisfied qualities.

Figure 3:
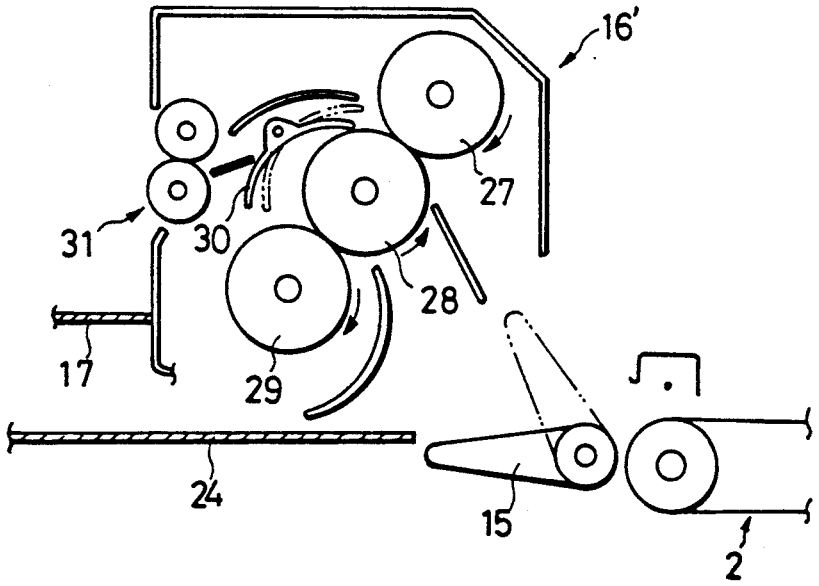
FIG. 3 is a view showing the construction of a general fixing section for switching fixing rollers.

In FIG. 3, another fixing device 16' is used to switch fixing roller sections. In such a structure, when the monochromatic copy (the so-called black-and-white copy) is obtained, a switching guide plate 30 is arranged in the position shown by a solid line. A transferred sheet of transfer paper is fed between fixing rollers 27 and 28 and is discharged from a pair of paper discharging rollers 31 onto a tray 17 while the sheet of transfer paper is guided by the switching guide plate 30.

When the color copy is obtained, the switching guide plate 30 is switched to the position shown by a phantom line. The sheet of transfer paper is fed between the fixing rollers 27 and 28 and is then fed between fixing rollers 28 and 29 while the sheet of transfer paper is guided by the switching guide plate 30. The sheet of transfer paper is then discharged onto a paper guide plate 24.

The fixing roller 27 is constructed by coating a circumferential face thereof with Teflon-based resin, etc. When the sheet of transfer paper is fed through such a fixing roller 27, the glossiness of the image tends to be reduced. The fixing roller 29 is constructed by coating a circumference face thereof with silicon rubber, etc. When the sheet of transfer paper is fed through such a fixing roller 29, the glossiness of the image tends to be increased.

Thus, images having high and low glossiness can be selectively obtained by switching the fixing roller sections. Such an apparatus can be applied to a case in which the entire face of the sheet of transfer paper is constructed by the monochromatic or color image. However, as shown in FIG. 1, such an apparatus cannot easily cope with an original having the character portion A and the picture portion B mixed with each other.

The construction and operation of the image forming apparatus in FIG. 2 will next be described in detail with reference to FIGS. 4 and 5.

Figure 4:
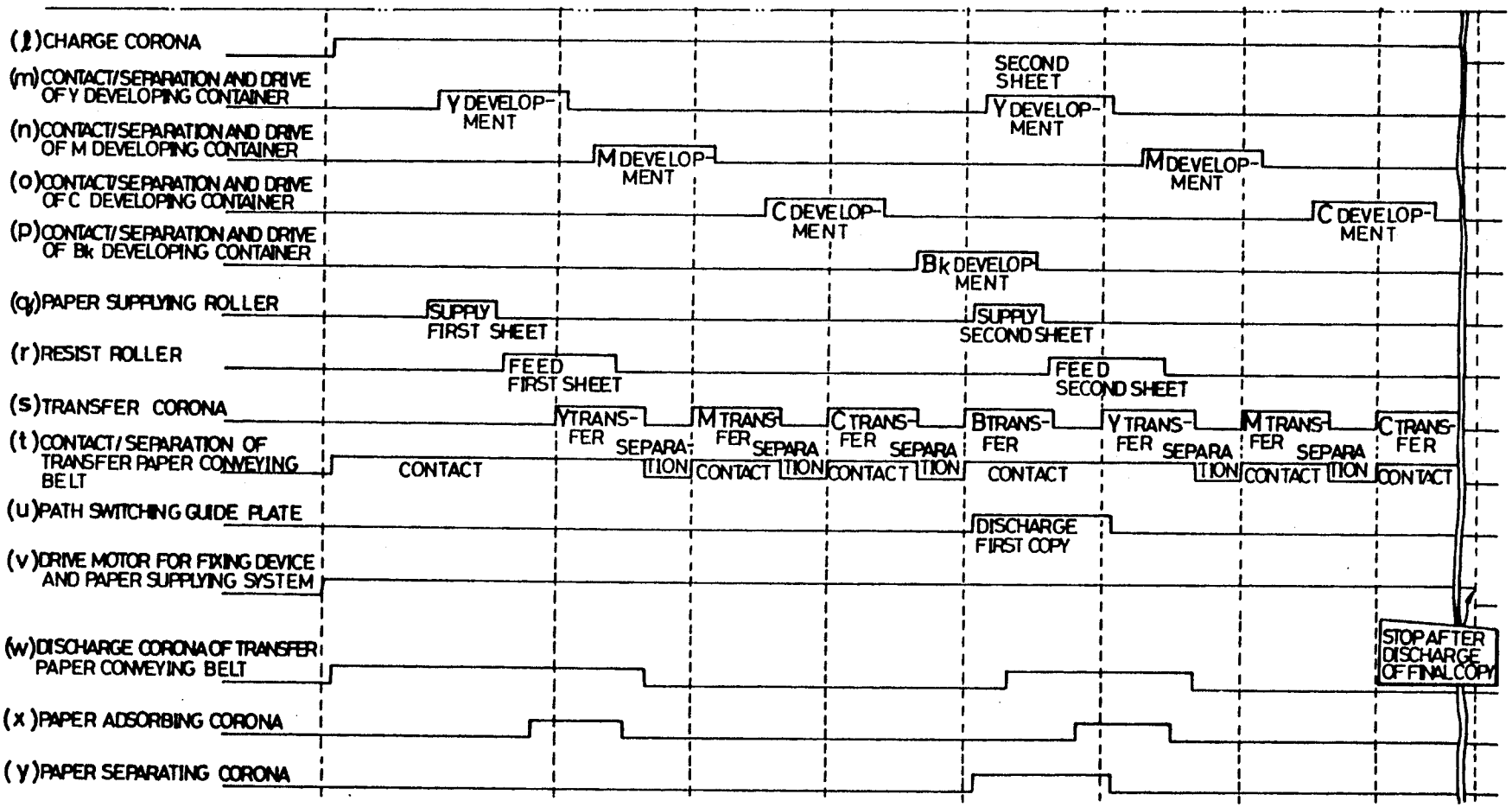
FIG. 4(*i*) and FIG. (*ii*) illustrate timing chart showing one example of basic operations of the image forming apparatus in FIG. 2.
Figure 5:
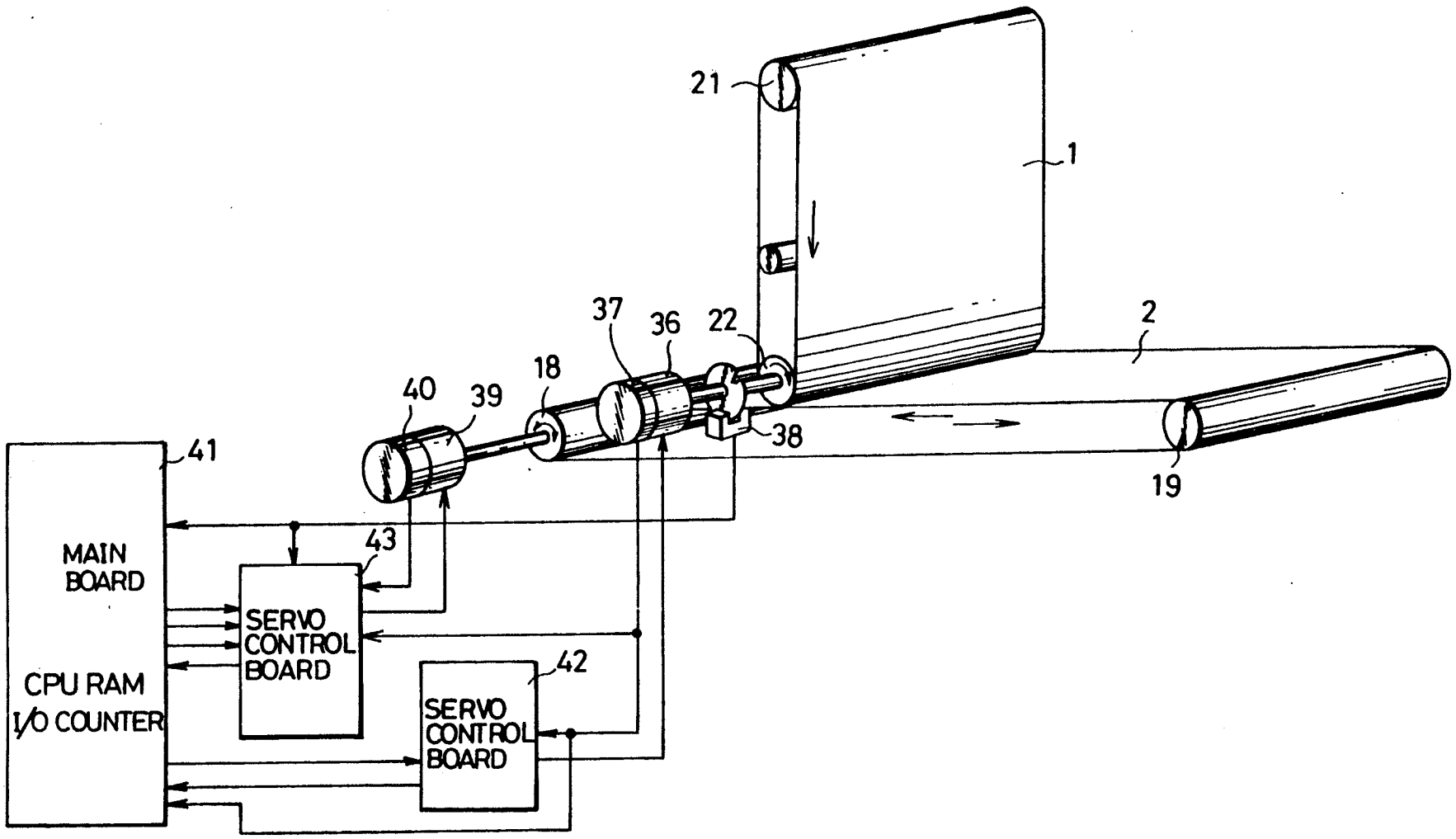
FIG. 5 is a block diagram of a driving section for controlling the operation of the image forming apparatus in FIG. 2.

When a printer switch is turned on as shown by item (a) of FIG. 4, A PC drive roller 22 is rotated in the clockwise direction by a PC drive motor 36 so that the photosensitive body belt (PC belt) 1 is moved and rotated at a line speed VP in an arrow direction.

Simultaneously, a transfer drive motor 39 is first started to be rotated in a normal direction (see signals shown by items (g) and (h) of FIG. 4 and a speed diagram shown by item (j) of FIG. 4). Thus, the transfer belt 2 is moved and rotated at a line speed VF in the left-handed direction under a condition in which the speeds VP and VF are equal to each other.

The photosensitive body belt 1 is discharged by the discharge device 26 and the entire surface of the photosensitive body belt 1 is uniformly charged by the charger 3 so as to satisfy the following conditions.

(1) Toner is removed by the cleaner from the surface of the photosensitive body belt in advance and light irradiation or corona discharge is performed on this surface of the photosensitive body belt by the discharge device so as to set a surface potential of the photosensitive body belt to approximately zero bolt.

(2) In the case of a negative-positive process, the toner is attached onto an uncharged portion of the surface of the photosensitive body belt. Therefore, the entire surface of the photosensitive body belt must be uniformly charged by the charger.

(3) Ozone is slightly generated when the surface of the photosensitive body belt is uniformly charged by the corona discharge using the charger. This ozone is decomposed for a short time when the discharging operation is stopped. However, the surface of the photosensitive body belt is adversely affected by this ozone so that an obtained image is not clear in a certain case. Therefore, the influence of the ozone is removed by supplying or sucking air from the rear side of the charger using an unillustrated fan, etc.

A rotary sensor 38 is disposed near an shaft of the PC drive roller 22 to detect the rotation thereof and outputs a detecting pulse every one rotation of this roller as shown by item (d) of FIG. 4.

In FIG. 4, a semiconductor laser of an optical write unit is started to be operated and controlled at a timing of a third pulse of this rotary sensor 38. In the following description, the semiconductor laser is used, but another optical write unit composed of another type laser, an LED array, an LCD array, etc. may be used. First, yellow image data are started to be optically written so as to form an electrostatic latent image.

These image data are provided as write image data of the yellow, magenta, cyan and black colors by respectively reading e.g., blue, green and red decomposed lights by a color image reading device 51 arranged in an upper portion of the apparatus in FIG. 2, and performing an image computing processing based on levels in light intensity of the respective colors.

These image data may be composed of those outputted from another color image processing system such as a color facsimile, a word processor, a personal computer, etc. In this case, a connection interface may be separately arranged.

The developing containers 5 to 8 for developing the electrostatic latent image is normally located such that the developing rollers 5A to 8A do not come in contact with the surface of the photosensitive body belt 1.

The developing container of a corresponding color is pressed in the left-handed direction in FIG. 2 for only a time between immediately before and after a latent image face of the corresponding color reaches the position of the developing roller of each color. Thus, the developing container is set in a position in which this developing roller comes in contact with the photosensitive body belt surface by a predetermined amount.

Simultaneously, as shown by items (m) to (p) of FIG. 4, this developing roller and constructional portions for performing the developing operation are started to be operated to provide a developing performance for only this developing container.

Since the latent image of the yellow image is first formed, the yellow developing container 5 comes in contact with the surface of the photosensitive body belt at a predetermined timing and is operated to develop the yellow image as shown by item (m) of FIG. 4.

In the next transfer process, the upper and lower positions of the roller 13 are switched such that the transfer belt 2 comes in contact with the surface of the photosensitive body belt or is separated therefrom in a transfer portion (a PC drive roller portion).

When a printing operation is started, the transfer belt 2 is moved in the left-handed direction as mentioned above. Thereafter, the contact/separation switching roller 13 is pressed upward so that the transfer belt 2 comes in contact with the photosensitive body belt 1 as shown by item (t) of FIG. 4.

Then, a sheet of transfer paper 9*a* is supplied by the paper supplying roller 10 at a predetermined timing and is then fed by the resist roller 11 at a timing at which the position of the sheet of transfer paper is in conformity with that of an image formed on the surface of the photosensitive body belt.

As shown by item (x) of FIG. 4, the corona charge of a predetermined polarity is performed by the paper adsorbing charger 12 with respect to the fed sheet of transfer paper 9*a* such that the sheet of transfer paper comes in close contact with the transfer belt and is not shifted therefrom during the transfer operation. The contact/separation switching roller 13 is commonly used as an electrode opposite to this paper adsorbing charger 12 to simplify the construction of the apparatus.

As shown by item (w) of FIG. 4, the entire surface of the transfer belt is uniformly discharged by a corona discharge device 54 before the transfer process with respect to the first color. At this time, the transfer belt is cleaned by the cleaner 55.

When a front end of the developed yellow image has reached a point TS separated from a transfer position T by a predetermined distance, a start signal $S_1$ for starting the transfer drive motor 39 in the normal direction is inputted to a control drive circuit 43 of the transfer drive motor 39 as shown by item (h) of FIG. 4. In this case, as shown by item (j) of FIG. 4, the transfer drive motor 39 is already rotated in the normal direction at the time point of the signal $S_1$ so that this transfer drive motor is continued to be rotated as it is.

At the timing of the signal $S_1$, the front end of the sheet of transfer paper substantially has reached a point RT located before the transfer point T by a distance $l_1$. Further, at the timing of the signal $S_1$, the front end of the yellow image on the photosensitive body belt 1 has reached the point TS located before the point T by a distance $l_1$.

As shown by items (d), (e), (f) and (h) of FIG. 4, at the time point of the signal $S_1$, the PC drive roller is rotated four times and is further rotated by the number $P_0$ of pulses of an encoder 37 of the PC drive motor from the write start timing of the yellow image data. In the meanwhile, the photosensitive body belt is moved from a point (image write position) E to the point TS.

After time $t_1$ has passed after the time point $S_1$, both the front ends of the yellow image and the sheet of transfer paper are moved by the distance $l_1$ and have reached the transfer point T so that the yellow image is transferred onto the sheet of transfer paper by the transfer corona charger 14.

As shown by items (e) and (k) of FIG. 4, at this time $t_1$, the number of pulses of the encoder 37 of the PC drive motor is $P_1$ and the number of pulses of an encoder 40 of the transfer drive motor is $PT_1$. With respect to resolution of both the encoders, the number $P_1$ is equal to the number $PT_1$ when the moving amounts of the respective belts per one pulse are equal to each other. When a ratio of the moving amounts of the respective belts per one pulse is $\alpha$, the numbers $P_1$ and $PT_1$ are values corresponding to the ratio $\alpha$.

The condition $P_1=PT_1$ is set in the following description.

When the processing for transferring the yellow image proceeds, the front end of the sheet of transfer paper is separated from the transfer belt and is moved toward a paper end guide plate 24 through the path switching member 15 shown by the solid line.

When the yellow image transfer processing further proceeds, the transfer drive motor is rotated in the reverse direction by a signal for rotating the transfer drive motor in the reverse direction at a time when the rear end of the sheet of transfer paper is moved by a distance $l_2$ from the point T, i.e., at a time $(t_1+t_2)$ when the sheet of transfer paper is moved by a distance $l_1+lp$ (the size of this paper sheet)$+l_2$ from the time point of the signal $S_1$. This state is shown by items (i) and (j) of FIG. 4. At this time $(t_1+t_2)$, the sheet of transfer paper 9*a* is located in a position shown by the broken line 34 in FIG. 2.

Before the transfer drive motor is rotated in the reverse rotation, the contact/separation switching roller 13 is lowered to separate the transfer belt from the surface of the photosensitive body belt.

The transfer belt and the sheet of transfer paper are quickly returned by the reverse rotation of the transfer drive motor in the right-handed direction at a speed VR (greater than VF). At this time, while the positions of the transfer belt and the sheet of transfer paper are controlled, they are returned for a short time $t_3$ in the right-handed direction by distances equal to the distances thereof moved in the left-handed direction for the time $t_1+t_2$.

At this returning time, the rear end of the sheet of transfer paper is separated from the transfer belt and is moved toward a paper rear end guide plate 58. Thus, the sheet of transfer paper 9*a* is accurately returned by a predetermined distance and is stopped in a position shown by a two-dotted chain line 33 in FIG. 2 in which the front end of the sheet of transfer paper is located at the point RT. Thus, a standby position for transfer a magenta image with respect to a second color is set at a time $t_4$.

The magenta image with respect to the second color is already formed on the photosensitive body belt 1 while the yellow image with respect to the first color is transferred onto the sheet of transfer paper. Namely, the optically written electrostatic latent image is started to be formed by the control and operation of the semiconductor laser based on the magenta image data when the PC drive roller is rotated by integer times such as four times in FIG. 4 from the write start of the yellow image.

With respect to the developing containers, the yellow developing container comes in contact with the photosensitive body belt 1 and is operated with respect to only a yellow image region. The yellow developing container 5 is separated from the photosensitive body belt 1 and the operation thereof is stopped before a magenta image region with respect to the second color reaches the yellow developing container.

As shown by item (n) of FIG. 4, the magenta developing container 6 comes in contact with the surface of the photosensitive body belt 1 and is operated after the yellow image region has passed through the magenta developing container 6 and before the front end of a magenta image region reaches the magenta developing container 6. Thus, only the latent image region of the magenta image is developed as the magenta image.

Similar to the case of the yellow image with respect to the first color, a start signal $S_2$ for starting the transfer drive motor in the normal direction is inputted to the control drive circuit 43 when the front end of the magneta image has reached the point TS, i.e., when the PC drive roller is rotated four times and is further rotated by the number $P_0$ of pulses of the encoder of the PC drive motor from the write start timing of the magenta image data.

Simultaneously or slightly after the input of this signal $S_2$, the contact/separation switching roller 13 is started to be pressed upward and comes in contact with the transfer belt 2 until at least the front end of the sheet of transfer paper reaches the point T.

Similar to the case of the yellow image, the photosensitive body belt 1 is moved by the distance $l_1$ and the number of pulses of the encoder of the PC drive motor is $P_1$ at the time $t_1$ from the inputting time of the signal $S_2$.

The speed of the sheet of transfer paper is also increased from zero to VF(=VP) for this time $t_1$. In the meanwhile, the position of the sheet of transfer paper is also controlled to provide the number of pulses equal to the number $PT_1$ of pulses at the time $t_1$ from the inputting time of the signal $S_1$ with respect to the first color, thereby forming $P_1=PT_1$.

Thus, the front end of the sheet of transfer paper is also moved by the distance $l_1$ for the time $t_1$ so that the yellow and magenta images with respect to the first and second colors are aligned with each other on the sheet of transfer paper.

The above-mentioned operations are similarly performed in the subsequent processings. Namely, the magenta image transfer, the quick return of the sheet of transfer paper, the writing operation of cyan image data, cyan development, the transfer of a cyan image, the quick return of the sheet of transfer paper, the writing operation of black image data, black development and the transfer of a black image are sequentially performed.

The processings after the transfer of the black image will next be described.

In the transfer process of the black image, the position of the path switching guide plate 15 is switched to a position shown by the two-dotted chain line. The sheet of transfer paper in the transfer process is discharged by a paper separating charger from the front end thereof and is moved toward the fixing device 16. The transfer drive motor 39 is continued to be rotated in the normal direction as it is even when the rear end of the sheet of transfer paper is completely transferred. Thus, as shown by items (j), (u), (v) and (y) of FIG. 4, the sheet of transfer paper is fed by the operation of the transfer drive motor 39 in the left-handed direction, thereby discharging a fixed color print onto the tray 17.

At this time, as shown by item (w) of FIG. 4, the corona discharge is uniformly performed with respect to the transfer belt 2 at a timing at which a rear end portion of the image region with respect to the first sheet has passed through the discharge device 54.

When the above-mentioned operations are repeatedly performed as shown in FIG. 4, the writing operation is performed with respect to the black image data on the first sheet. Thereafter, the writing operation is subsequently performed with respect to the yellow image data on the second sheet as shown in FIG. 4. Further, the operation of the transfer belt with respect to the second sheet of transfer paper is similar to that with respect to the first sheet of transfer paper.

The toner left on the photosensitive body belt 1 is removed therefrom by the cleaner 25 after the transfer operation. Further, the charge left on the photosensitive body belt 1 is discharged by the discharge device 26 and the photosensitive body belt 1 is then moved toward the charger 3.

The final color print is thus discharged onto the tray 17 and the operation of the apparatus is stopped after the cleaning and discharging operations of the photosensitive body belt 1 and the transfer belt 2, thereby returning to the initial state.

In the above-mentioned description, the yellow, magenta, cyan and black images are sequentially formed and the yellow, magenta, cyan and black developing containers are sequentially arranged from above, but the present invention is not limited to these sequential formation and arrangement.

Further, the electrostatic latent image of the respective colors is formed by the system for performing the optical writing operation using a semiconductor laser, etc. with respect to the image data of the respective colors digitally processed. However, a color copying operation can be similarly performed by focusing an analog optical image formed by the normal electrophotographic copying machine at the point E by controlling the position thereof at a predetermined timing.

In the above-mentioned embodiment, the yellow, magenta, cyan and black images are overlapped with each other. When two or three of these four colors are overlapped with each other to provide a two or three color copy, the constructional portions of the apparatus are controlled so as to complete the overlapping operation by subsequently forming and transferring the images of required colors two or three times.

In the case of a single color copy, the developing container of this color comes in contact with the photosensitive body belt and is operated while a predetermined number of sheets are completely developed. Further, the transfer belt continuously comes in contact with the photosensitive body belt and the path switching guide plate 15 is held in a position for guiding the sheets of transfer paper toward the fixing device 16, thereby performing the copying operation.

Accordingly, in the case of the three color copy, the printing operation is performed at a speed 4/3 times that in the case of the four color copy. In the case of the two or one color copy, the printing operation is respectively performed at a speed two or four times that in the case of the four color copy.

The developed colors are not limited to the above-mentioned four colors, but can be constructed by a combination of blue, green, red and other desirable colors in accordance with necessity.

Figure 6:
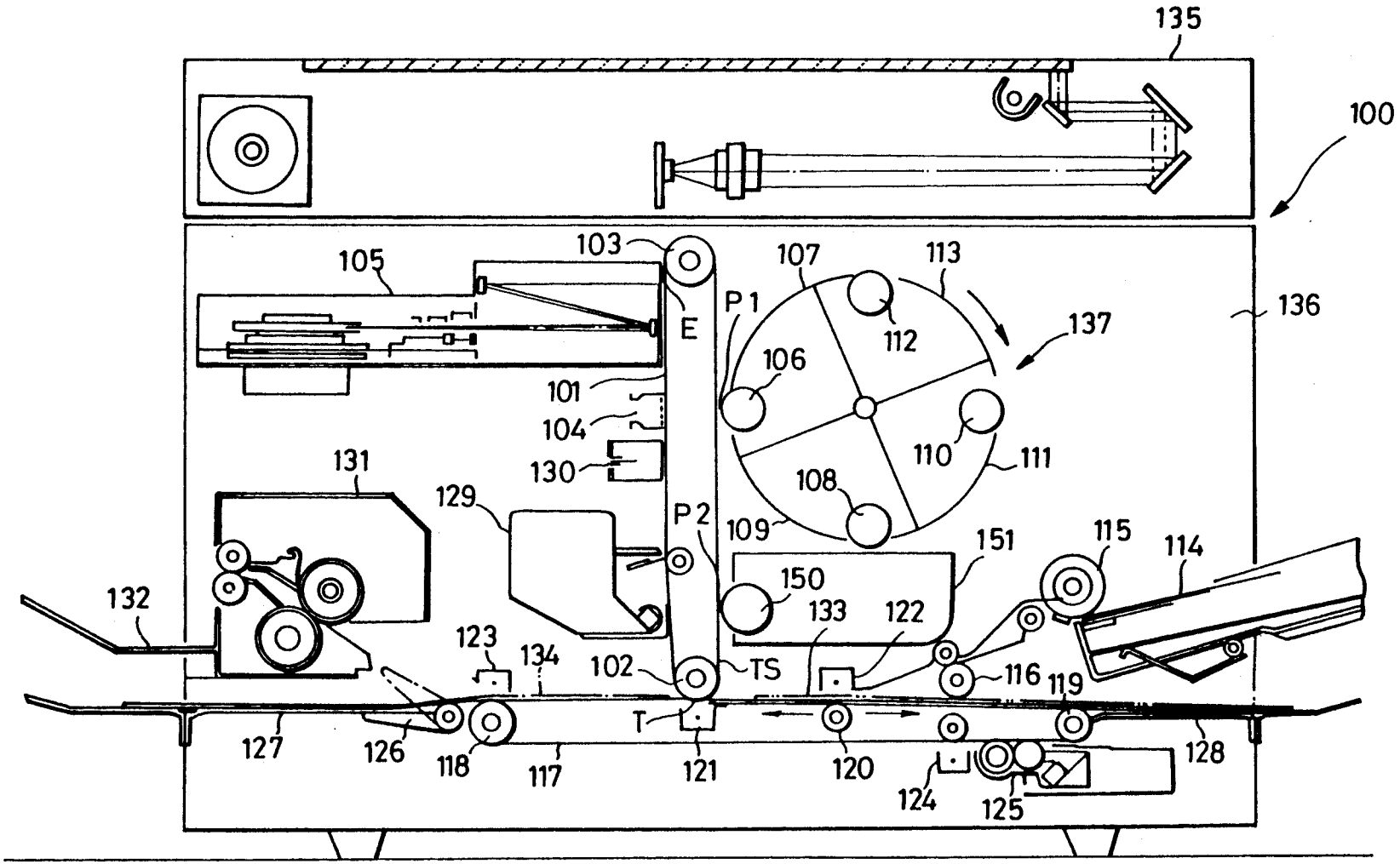
FIG. 6 is an explanatory view showing the structure of a color image processing apparatus in a first embodiment of the present invention applied to a copying machine.

FIG. 6 is an explanatory view of an apparatus for processing a color image in a first embodiment of the present invention applied to a color copying machine.

In FIG. 6, a color copying machine 100 has an image information reading section 135 for reading image information from an unillustrated original. The color copying machine 100 further has an image information processing section 136 for performing a series of copying processings to copy the image information read by the image information reading section 135 onto a sheet of transfer paper 114.

The image information processing section 136 has a photosensitive body belt 101 for forming an electrostatic latent image and performing a developing processing with respect to this electrostatic latent image. The image information processing section 136 further has a drive roller 102 for moving and rotating the photosensitive body belt 101 and a driven roller 103 driven by the driving operation of the drive roller 102. The image information processing section 136 further has a charger 104 for uniformly charging a surface of the photosensitive body belt 101 and an optical write unit 105 for performing an exposing processing with respect to the photosensitive body belt 101 charged by the charger 104.

The image information processing section 136 further has a developing device 137 provided with developing containers 107, 109, 111 and 113 corresponding to red, green and blue colors of the original to perform a color developing processing with respect to the electrostatic latent image formed in a first developing position P1 of the photosensitive body belt 101. The developing container 107 stores a yellow developer and has a developing roller 106. The developing container 109 stores a magenta developer and has a developing roller 108. The developing container 111 stores a cyan developer and has a developing roller 110. The developing container 113 stores a black developer having a low melting temperature and corresponding to a color image and has a developing roller 112. The developing device 137 can selectively move the plural developing containers to the first developing position P1.

The image information processing section 136 further has a developing device 151 having a developing roller 150. The developing device 151 stores a black developer having a high melting temperature and corresponding to a black-and-white image to perform a black-and-white developing processing with respect to an electrostatic latent image formed in a second developing position P2 of the photosensitive body belt 101. The image information processing section 136 further has sheets of transfer paper 114 arranged in a paper supplying section to transfer a developed image thereon and a paper supplying roller 115 for supplying a sheet of transfer paper 114 from the paper supplying section. The image information processing section 136 further has a resist roller 116 for conveying the sheet of transfer paper 114 supplied from the paper supplying roller 115 to a transfer portion T.

The image information processing section 136 further has a transfer belt 117 for moving the transfer portion T plural times to perform a plurality of transfer processings with respect to the sheet of transfer paper 114 conveyed by the resist roller 116. The image information processing section 136 further has a transfer drive roller 118 for moving and rotating the transfer belt 117 and a transfer driven roller 119 driven by the transfer drive roller 118. The image information processing section 136 further has a contact/separation switching roller 120 for moving the transfer belt 117 upward and downward and a transfer device 121 for transferring the developed image on the photosensitive body belt 101 to the conveyed sheet of transfer paper 114.

The image information processing section 136 further has a transfer paper adsorbing charger 122 for charging the transfer belt 117 on the sheet of transfer paper 114 to electrically suck and move the sheet of transfer paper 114 onto a surface of the transfer belt 117. The image information processing section 136 further has a transfer paper separating charger 123 for electrically separating the sheet of transfer paper 114 sucked on the transfer belt 117 by the transfer paper adsorbing charger 122 from the transfer belt 117. The image information processing section 136 further has a discharge device 124 for releasing the charging state of the transfer belt 117 provided by the transfer paper adsorbing charger 122 and the transfer paper separating charger 123.

The image information processing section 136 further has a transfer belt cleaner 125 for cleaning the surface of the transfer belt 117 to prepare it for the next transfer processing. The image information processing section 136 further has a path switching member 126 for changing the conveying direction of the sheet of transfer paper 114 separated from the transfer belt 117, and a transfer paper front end guide plate 127 for guiding a front end portion of the sheet of transfer paper 114 while the plurality of transfer processings are performed. The image information processing section 136 further has a transfer paper rear end guide plate 128 for guiding a rear end portion of the sheet of transfer paper while the plurality of transfer processings are performed.

The image information processing section 136 further has a cleaner 129 for cleaning a surface of the photosensitive body belt 101 after the transfer processings, and a discharge device 130 for discharging the photosensitive body belt 101 to prepare it for the next copying processing. The image information processing section 136 further has a fixing device 131 for fixing the transferred image onto the sheet of transfer paper 114 after the transfer processings. The image information processing section 136 further has a tray 132 for holding the fed sheet of transfer paper 114 fixed by the fixing device 131 outside the copying machine 100.

The operation of the above-mentioned apparatus for processing a color image will next be described.

(1) When the color image is processed, the operation of the color image processing apparatus is as follows.

The contents of a color original are read by the image information reading section 135 and are outputted to the optical write unit 105 of the image information processing section 136. An entire surface of the photosensitive body belt 101 in the image information processing section 136 is discharged by the discharge device 130 and is uniformly charged by the charger 104. Next, the photosensitive body belt 101 is moved by the operations of the drive roller 102 and the driven roller 103 to perform an exposing processing with respect to the image. In this exposing processing, an optical write processing is first performed on the basis of yellow image information by driving and controlling a semiconductor laser, etc. in the optical write unit 105. Thus, an electrostatic latent image corresponding to the yellow image information is formed on a surface of the photosensitive body belt 101.

This image information is provided as write image information of yellow, magenta, cyan and black colors by respectively reading three decomposed lights composed of e.g., blue, green and red colors using the image information reading section 135 and performing an image computing processing based on intensity levels of these color lights. Thereafter, with respect to the electrostatic latent image of the yellow image formed on the photosensitive body belt 101, the yellow developing container 107 comes in contact with the surface of the photosensitive body belt 101 and is operated so that the yellow image is developed by the operation of the developing roller 106.

The upward and downward positions of the contact/separation switching roller 120 are switched such that the transfer belt 117 comes in contact with the photosensitive body belt 101 in the transfer portion T.

In the transfer processing, the transfer belt 117 is moved in the direction of a left-handed arrow in FIG. 6. Then, the contact/separation switching roller 120 is pressed upward so that the transfer belt 117 comes in contact with the photosensitive body belt 101. A sheet of transfer paper 114 is then supplied by the paper supplying roller 115 at a predetermined timing and is conveyed by the resist roller 116 at a timing at which the position of the sheet of transfer paper is in conformity with that of an image formed on the photosensitive body belt 101.

A charging processing of a predetermined polarity is then performed by the transfer paper adsorbing charger 122 with respect to the conveyed sheet of transfer paper 114. The sheet of transfer paper 114 then comes in close contact with the transfer belt 117 so as not to shift the position of the sheet of transfer paper 114 during the transfer processing thereof.

The contact/separation switching roller 120 is commonly used as an electrode opposite to this transfer paper adsorbing charger 122 so as to simplify the construction of the apparatus.

The entire surface of the transfer belt 117 is uniformly discharged by the discharge device 124 before the transfer process with respect to the first color. Simultaneously, the surface of the transfer belt 117 is cleaned by the transfer belt cleaner 125.

The transfer belt 117 is driven when a front end of the yellow image developed on the photosensitive body belt 117 has reached a position TS. The transfer processing is performed by the transfer device 121 after front end portions of the yellow image and the sheet of transfer paper 114 have reached a transfer point T.

When the processing for transferring the yellow image is performed, the front end portion of the sheet of transfer paper 114 is separated from the transfer belt 117 and is moved toward the transfer paper front end guide plate 127 through the path switching member 126 shown by the solid line (see a position 134 of the sheet of transfer paper shown by one-dotted chain line).

Thereafter, the transfer belt 117 is moved and rotated in a direction reverse to the above direction. Before the reverse rotation of the transfer belt 117, the contact- /separation switching roller 120 is lowered to separate the transfer belt 117 from the photosensitive body belt 101. The transfer belt 117 and the sheet of transfer paper 114 are quickly returned by the reverse rotation of the transfer belt 117 in the direction of a right-handed arrow at a speed faster than that in the direction of the left-handed arrow. When the transfer belt 117 and the sheet of transfer paper 114 are returned, the rear end of the sheet of transfer paper 114 is separated from the transfer belt 117 and is moved toward the transfer paper rear end guide plate 128. Then, the sheet of transfer paper 114 is accurately returned by a predetermined distance and the sheet of transfer paper 114 is stopped in a position 133 shown by a two-dotted chain line, thereby providing a standby state for transferring a magenta image with respect to a second color.

The magenta image with respect to the second color is formed on the photosensitive body belt 101 while the yellow image with respect to the first color is transferred onto the sheet of transfer paper. Namely, the electrostatic latent image is formed by an exposing processing performed by driving and controlling the semiconductor laser based on the magenta image information. The developing device 137 is next rotated to move the developing container 109 to the first developing position P1. Thus, the developing roller 108 of the developing container 109 comes in contact with a surface of the photosensitive body belt 101 and is operated to develop the magenta image only in a region for the magenta electrostatic latent image.

Similar to the case of the yellow image, when a front end portion of the above magenta image has reached the position TS, the transfer belt 117 is moved in the direction of the left-handed arrow. Simultaneously or slightly after this left-handed movement of the transfer belt 117, the contact/separation switching roller 120 is pressed upward and comes in contact with the transfer belt 117 until at least the front end of the sheet of transfer paper 114 reaches the transfer portion T. Further, the yellow and magenta images with respect to the first and second colors are aligned with each other on the sheet of transfer paper 114 by a positioning control thereof. Thereafter, the above-mentioned processings are repeatedly performed. Namely, the transfer processing of the magenta image is performed by the transfer device 121 and the sheet of transfer paper 114 is then quickly returned. Thereafter, cyan image information is written and the cyan image is then developed by the cyan developer and is transferred onto the sheet of transfer paper. Then, the sheet of transfer paper 114 is quickly returned and black image information is then written. Thereafter, the developing container 113 for storing the black developer having a low melting temperature is moved to the first developing position P1. The developing processing of the image is then performed by the black developer and the black image and the sheet of transfer paper 114 are overlapped with each other, thereby transferring the black image onto the sheet of transfer paper.

In the transfer process of the black image, the position of the path switching member 126 is switched to the position shown by a one-dotted chain line in FIG. 6. The transferred sheet of the transfer paper 114 is moved toward the fixing device 131 while the sheet of transfer paper 114 is discharged from a front end portion thereof by the transfer paper separating charger 123. The transfer belt 117 is continued to be rotated in the normal direction and convey the sheet of transfer paper 114 in the left-handed direction even when the rear end of the sheet of transfer paper is completely transferred. The color sheet of transfer paper 114 fixed by the fixing device 131 is then discharged onto the tray 132 and the operating state of the apparatus is returned to the initial state thereof.

(2) When a black-and-white image processing is performed, the operation of the apparatus is as follows.

The contents of a black-and-white original are read by the image information reading section 135 and are outputted to the optical write unit 105 of the image information processing section 136. An entire surface of the photosensitive body belt 101 in the image information processing section 136 is discharged by the discharge device 130 and is uniformly charged by the charger 104. Next, the photosensitive body belt 101 is moved by the operations of the drive roller 102 and the driven roller 103 to perform an exposing processing with respect to the image. In this exposing processing, an optical write processing is performed on the basis of the image information by driving and controlling a semiconductor laser, etc. in the optical write unit 105. Thus, an electrostatic latent image corresponding to the image information is formed on the surface of the photosensitive body belt 101.

Thereafter, with respect to the electrostatic latent image of the black-and-white image formed on the photosensitive body belt 101, the developing device 151 comes in contact with the surface of the photosensitive body belt 101 in a second phantom position P2 and is operated to develop the black-and-white image by the developing roller 150 using a black developer stored within the developing device 151 and having a high melting temperature.

The upward and downward positions of the contact/separation switching roller 120 are switched such that the transfer belt 117 comes in contact with the photosensitive body belt 101 in the transfer portion T.

In the transfer processing, the transfer belt 117 is moved in the direction of the left-handed arrow in FIG. 6 and the contact/separation switching roller 120 is then pressed upward. Thus, the transfer belt 117 comes in contact with the photosensitive body belt 101. A sheet of transfer paper 114 is then supplied by the paper supplying roller 115 at a predetermined timing and is conveyed by the resist roller 116 at a timing at which the position of the sheet of transfer paper is in conformity with that of an image formed on the photosensitive body belt 101.

A charging processing of a predetermined polarity is then performed by the transfer paper adsorbing charger 122 with respect to the conveyed sheet of transfer paper 114. The sheet of transfer paper 114 then comes in close contact with the transfer belt 117 so as not to shift the position of the sheet of transfer paper 114 during the transfer processing thereof.

The transfer belt 117 is driven when a front end of the black-and-white image developed on the photosensitive body belt 117 has reached the position TS. The transfer processing is performed by the transfer device 121 after front end portions of the black-and-white image and the sheet of transfer paper 114 have reached the position of the transfer portion T.

In the image transfer process, the position of the path switching member 126 is switched to the position shown by the one-dotted chain line in FIG. 6. The transferred sheet of the transfer paper 114 is moved toward the fixing device 131 while the sheet of transfer paper 114 is discharged from a front end portion thereof by the transfer paper separating charger 123. The sheet of transfer paper 114 of the black-and-white image fixed by the fixing device 131 is then discharged onto the tray 132 and the operating state of the apparatus is returned to the initial state thereof.

The glossiness of the black developers can be measured by a GLOSS SENSOR. The GLOSS SENSOR measures a fixing amount of toner. The glossiness of the black developers is obtained by representing in percentage terms the deposited amount of the toner measured by the GLOSS SENSOR on the basis of the average deposited amount of the toner of about 1 mg/cm$^2$.

The glossiness of the black toner suited for the black-and-white image copying operations is not greater than about 10%, preferably, not greater than about 5%. The glossiness of the black toner suited for the color image copying operations is from about 10% to 40%, preferably, about 15% to 30%.

The melting temperatures of the black developers can be measured by a FLOW TESTER. The FLOW TESTER measures a softening temperature of toner (a temperature at which the toner starts to out flow). A load condition of the FLOW TESTER is 10 kg.

The softening temperature of the black toner suitable for the white-and-black image copying operations is about from 80° C. to 90° C. The softening temperature of the black toner suitable for the color image copying operation is preferably about 70° C.

As mentioned above, in the present invention, the black developers having melting temperatures different from each other are separately used in accordance with the copying operations of the black-and-white image and the color image. Accordingly, in the case of the black-and-white image, it is possible to provide an image having no gloss and easy to read. In contrast to this, in the case of the color image, it is possible to provide a glossy image having a good appearance.

Further, in the case of the color image processing, the developing processings with respect to the yellow, magenta, cyan and black colors are respectively performed in the same position of the photosensitive body. Therefore, the position relation of the means for forming the electrostatic latent image in the charging and exposing operations, etc. is constant so that developing conditions with respect to the respective colors are constant at any time. Therefore, it is easy to perform a switching control, etc. with respect to the respective developing containers and it is possible to prevent a shift in color image from being caused.

Further, although the five developing containers are used as a total, it is sufficient to set only two developing positions on the path of the photosensitive body so that the apparatus can be made compact.

As mentioned above, in the present invention, an apparatus for processing a color image comprises a first developing device having a plurality of developing sections for performing a developing processing by each of yellow, magenta, cyan and black developers corresponding to an electrostatic latent image of each color formed by means for forming the electrostatic latent image; moving means for selectively moving the developing sections of the first developing device to a first developing position on a moving path of the photosensitive body; and a second developing device disposed in a second developing position on the moving path of the photosensitive body and performing the developing processing by a black developer with respect to a black-and-white image. A melting temperature of the black developer within the first developing device is set to be lower than that of the black developer within second developing device.

Accordingly, glossiness is suitably secured with respect to the processings of both the black-and-white image and the color image. In the case of the black-and-white image, it is possible to prevent fatigue of eyes and provide an image easy to read. In the case of the color image, a bright image having a good appearance is obtained and it is easy to perform a switching control with respect to the developing containers in accordance with the black-and-white image and the color image and it is possible to prevent the shift in color image from being caused.

Figure 7:
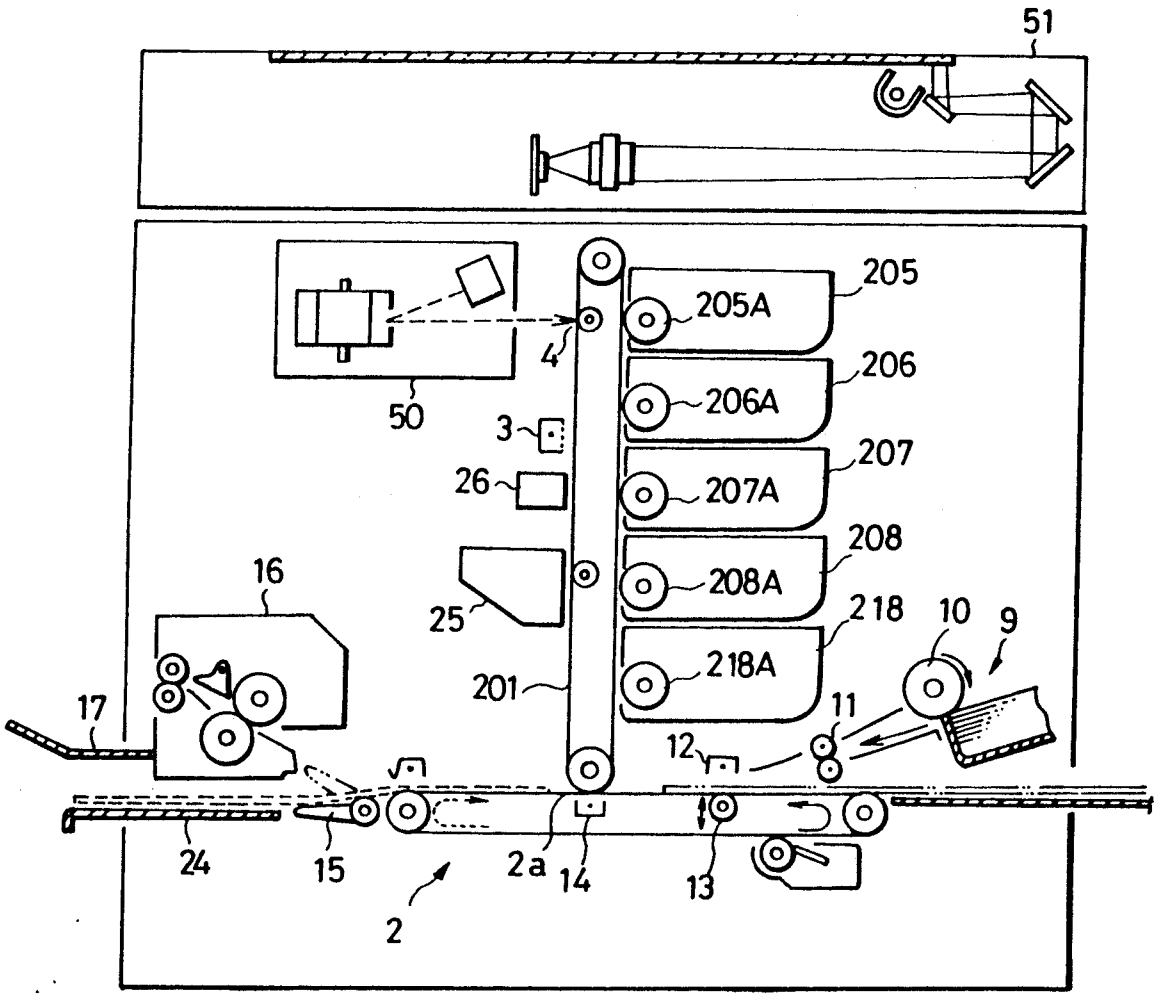
FIG. 7 is a view schematically showing the construction of an image forming apparatus in a second embodiment of the present invention.

FIG. 7 shows an image forming apparatus in a second embodiment of the present invention. The features of this embodiment are that two black developing containers are disposed. In FIG. 7, constructional portions corresponding to those in FIG. 2 are designated by the same reference numerals.

Namely, a plurality of developing containers 205 to 207 are opposite to a photosensitive body 201 and are disposed to develop electrostatic latent images on the photosensitive body 201 using toners having colors different from each other except for black. A developing container 208 is also opposite to the photosensitive body 201 and stores black toner for a color image to increase the glossiness of the image after a fixing operation thereof. A developing container 218 is also opposite to the photosensitive body 201 and stores black toner for a monochromatic image to reduce the glossiness of the image after the fixing operation thereof.

When an image developed on the photosensitive body 201 every color is overlapped and transferred onto a sheet of transfer paper to provide a color image, developing sleeves 205A to 208A, etc. are sequentially rotated and operated with respect to the respective developing containers 205 to 208. Namely, the black developing container 208 is used when a full color copy having a picture image, etc. is obtained by overlapping yellow, magenta, cyan and black developed images with each other. The glossiness of the image having a picture, etc. is improved and the image becomes clear by using this black developing container 208.

On the other hand, when a copy of a normal monochromatic image instead of the color image is obtained, only the black developing container 218 is operated and used by rotating a developing sleeve 218A. The generally used black toner for a monochromatic copy is stored within the black developing container 218. Thus, an image having less glossiness and characters and lines easy to read is obtained.

When the original having the character portion A and the picture portion B mixed with each other as shown in FIG. 1 is used, a certain region of the original is designated by an editor, or both the character and picture portions are separated from each other when the original is read by a scanner. Thus, for example, the black developing container 208 is used together with the other color developing containers with respect to the picture portion, and the black developing container 218 is used with respect to the character portion, thereby performing the developing operation every portion of the original. In this case, the five developing containers are used.

This second embodiment of the present invention can be also applied to an image forming apparatus using a drum-shaped photosensitive body as a latent image carrier in addition to the above-mentioned photosensitive body in the shape of a belt. Further, the second embodiment of the present invention can be also applied to an image forming apparatus using another latent image carrier except for such photosensitive bodies.

Figure 8:
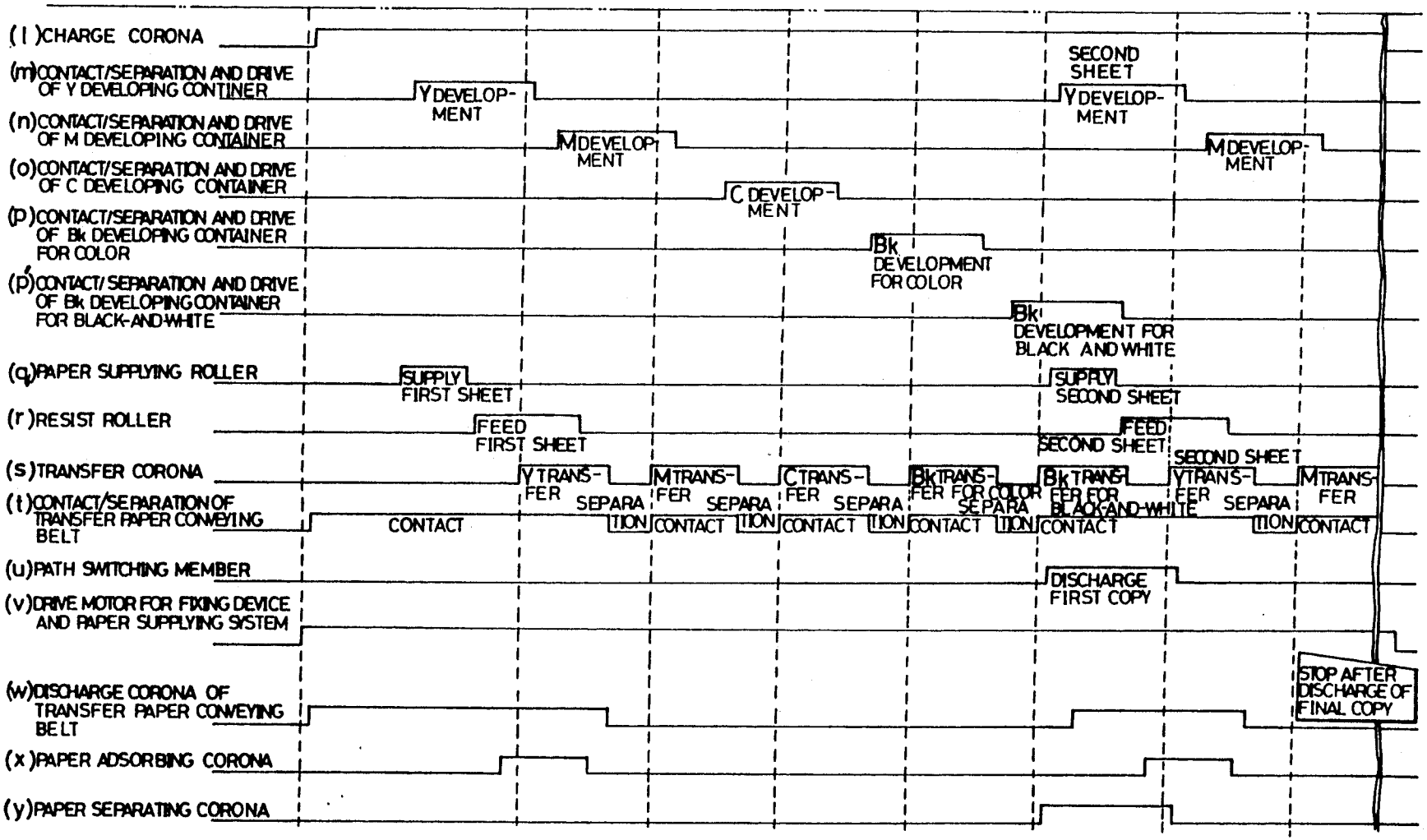
FIG. 8(*i*) and FIG. 8(*ii*) illustrate a timing chart showing one example of basic operation of the image forming apparatus in the second embodiment of the present invention.

FIG. 8 shows one example of a timing chart showing the operation of the image forming apparatus in FIG. 7 in five development copy modes. In the timing chart of FIG. 8, the operations of the respective constructional portions of the apparatus is approximately similar to those in FIG. 4 except for added black data for a black-and-white image.

Namely, in FIG. 8, the image processings of the apparatus until the processing of the black data for color are similar to those in FIG. 4. The black data for a black-and-white image are processed as follows.

A black image for black-and-white with respect to a fifth color is already formed on the photosensitive body belt 1 while the black image for color with respect to the fourth color is transferred onto the sheet of transfer paper. Namely, the optically written electrostatic latent image is started to be formed by the control and operation of the semiconductor laser based on the black image data for black-and-white when the PC drive roller is rotated by integer times such as four times in FIG. 8 from the write start of the black image for color.

With respect to the developing containers, the black developing container for color comes in contact with the photosensitive body belt 1 and is operated with respect to only a black image region for color. The black developing container 208 for color is separated from the photosensitive body belt 1 and the operation thereof is stopped before a black image region for black-and-white with respect to the fifth color reaches the black developing container for color.

As shown by item (p') of FIG. 8, the black developing container 218 for black-and-white comes in contact with the surface of the photosensitive body belt 1 and is operated after the black image region for color has passed through the black developing container 218 and before the front end of a black image region for black-and-white reaches the black developing container 218. Thus, only the latent image region of the black image for black-and-white is developed as the black image for black-and-white.

Similar to the case of the yellow image with respect to the first color, a start signal $S_5$ for starting the transfer drive motor in the normal direction is inputted to the control drive circuit 43 when the front end of the black image for black-and-white has reached the point TS, i.e., when the PC drive roller is rotated four times and is further rotated by the number $P_0$ of pulses of the encoder of the PC drive motor from the write start timing of the black image data for black-and-white.

Simultaneously or slightly after the input of this signal $S_5$, the contact/separation switching roller 13 is started to be pressed upward and comes in contact with the transfer belt 2 until at least the front end of the sheet of transfer paper reaches the point T.

Similar to the case of the yellow image, the photosensitive body belt 1 is moved by the distance $l_1$ and the number of pulses of the encoder of the PC drive motor is $P_1$ at the time $t_1$ from the inputting time of the signal $S_5$.

The speed of the sheet of transfer paper is also increased from zero to VF (=VP) for this time $t_1$. In the meanwhile, the position of the sheet of transfer paper is also controlled to provide the number of pulses equal to the number $PT_1$ of pulses at the time $t_1$ from the inputting time of the signal $S_1$ with respect to the first color, thereby forming $P_1=PT_1$.

Thus, the front end of the sheet of transfer paper is also moved by the distance $l_1$ for the time $t_1$ so that the black images for color and black-and-white with respect to the fourth and fifth colors are aligned with each other on the sheet of transfer paper.

The subsequent processings are similar to those described in relation to FIG. 4.

In accordance with the image forming apparatus in the above second embodiment of the present invention, it is possible to provide an image having less glossiness and easy to read when a monochromatic image copy is obtained. When a color image is obtained, it is possible to provide a bright image having high glossiness and a good appearance. In the case of an image having picture and character portions mixed with each other, an image easy to read can be obtained with respect to the character portion and a clear image can be obtained with respect to the picture portion, and these images can be obtained on the same plane.

Figure 9:
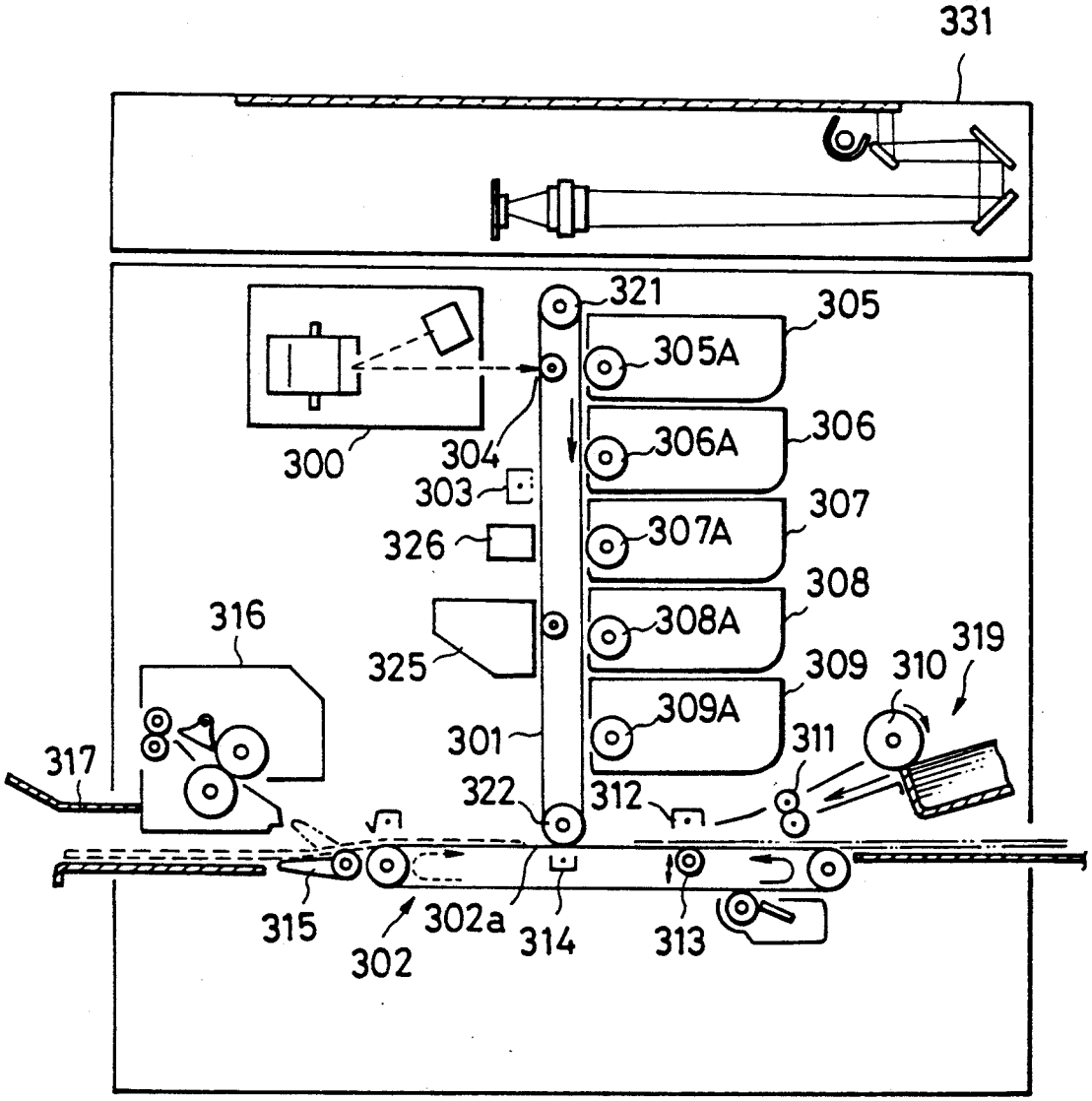
FIG. 9 is a schematic view showing the construction of an image forming apparatus in accordance with a third embodiment of the present invention.

In FIG. 9, a photosensitive body 301 is formed in the shape of an endless belt as one constructional example of a latent image carrier. The photosensitive body 301 is disposed between two rollers 321 and 322. In this embodiment, the photosensitive body 301 is arranged in a vertical direction. This photosensitive body 301 is moved and rotated in a direction shown by an arrow. A surface of the photosensitive body 301 is uniformly charged by a charger 303. When an optical writing operation with respect to this charged surface of the photosensitive body 301 is performed by an optical writing device 300 in a recording portion 304, an electrostatic latent image is formed on the charged surface of the photosensitive body 301. In an image forming apparatus of an image exposing type, the electrostatic latent image is formed in such a recording portion by focusing and projecting an original image.

Developing containers 305, 306, 307, 308 and 309 are respectively opposed to the photosensitive body 301. These developing containers are arranged along the moving direction of the photosensitive body 1. The developing containers 305 to 308 respectively store developers having colors different from each other. These developers are constructed by developers of a two-component system having carriers and color toners composed of yellow, magenta, cyan and black toners. Every time a developing operation is performed, the electrostatic latent image formed on the photosensitive body in advance is developed by each of the color toners as a toner image every color.

A sheet of transfer paper as one example of a transfer material is fed from a paper supplying section 319 by a paper supplying roller 310 in a direction shown by an arrow in FIG. 9. The sheet of transfer paper is conveyed toward a transfer belt 302 in a resist roller 311 at a predetermined timing.

The transfer belt 302 is moved and rotated in the direction of an arrow shown by a solid line in FIG. 9. The sheet of transfer paper is electrostatically adsorbed by a paper adsorbing charger 312 on a flat belt portion 302*a* of the transfer belt 302 on an upper side thereof. The sheet of transfer paper is conveyed leftward on the transfer belt 302 in this adsorbing state. At this time, a developed image of a first color formed on the photosensitive body 301 is transferred onto the sheet of transfer paper by a transfer corona charger 314. At this transfer time, a contact/separation switching roller 313 is raised so that a transfer belt portion opposite to the transfer corona charger 314 comes in contact with the photosensitive body 301.

After the transfer operation, the sheet of transfer paper is fed until a going terminal position shown by a broken line in FIG. 9. Thereafter, the transfer belt 302 is moved and rotated in the direction of a broken line arrow opposite to the direction of the solid line arrow in a state in which the contact/separation switching roller 313 is lowered. Thus, the sheet of transfer paper is returned until a returning terminal position shown by a phantom line. In the following description, the moving direction of the transfer belt 302 shown by the solid line arrow is called a normal rotational direction, and the moving direction of the transfer belt 302 shown by the broken line arrow is called a reverse rotational direction.

Next, the transfer belt 302 is again rotated in the normal rotational direction. At this time, a developed image of a second color on the photosensitive body 301 is transferred onto the sheet of transfer paper conveyed together with the transfer belt. In this case, the contact-/separation switching roller 313 is raised. Thereafter, the above-mentioned operations are similarly performed and the transfer operation is performed four times at most. Thus, the developed toner images composed of four colors are overlapped with each other and are transferred onto the sheet of transfer paper. The black developing container 308 is also used in addition to the developing containers 305 to 307 for color since a digital system for performing the optical writing operation is used in many cases. After all such transfer operations are completed, the sheet of transfer paper is guided onto the side of a fixing device 316 by a path switching member 315 switched to the position shown by a phantom line in FIG. 9. The sheet of transfer paper is then fixed by a fixing section of the fixing device 316 and is discharged onto a tray 317, thereby obtaining a sheet of color copy paper. After the transfer operations, the surface of the photosensitive body 301 is cleaned by a cleaner 325 and the photosensitive body 301 is discharged by a discharge device 326. In FIG. 9, reference numeral 331 designates a device for reading an original.

The features of this embodiment reside in two black developing containers.

Namely, the developing containers 308 and 309 are respectively opposed to the photosensitive body 301 in addition to the plural developing containers 305 to 307 for developing the electrostatic latent image on the photosensitive body 301 by the respective toners having different colors except for black. Similar to the developing containers 305 to 307, the developing container 308 stores a developer having black toner for color used to increase the glossiness of a fixed image. The developer 309 stores a developer of a two-component system having carrier and black toner for a monochromatic image used to reduce the glossiness of a fixed image.

When a color image is obtained by overlapping and transferring the developed image on the photosensitive body 301 onto the sheet of transfer paper every color, the developing containers 305 to 308 are sequentially operated by sequentially rotating developing sleeves 305A to 308A, etc. The black developing container 308 is used when a sheet of paper of a full color copy having a picture image, etc. is obtained by overlapping yellow, magenta, cyan and black developed images with each other. The glossiness of the image having a picture, etc. is improved by using the black developing container 308, thereby providing a clearer image.

When a sheet of copy paper of a normal monochromatic image instead of the color image is obtained, only the black developing container 309 is operated by rotating the developing sleeve 309A, etc. The black developing container 309 stores black toner for a monochromatic copy used in the general image forming apparatus. An image constructed by diagrams and characters easy to see and having a low glossiness is obtained by using the black developing container 309.

Figure 11:
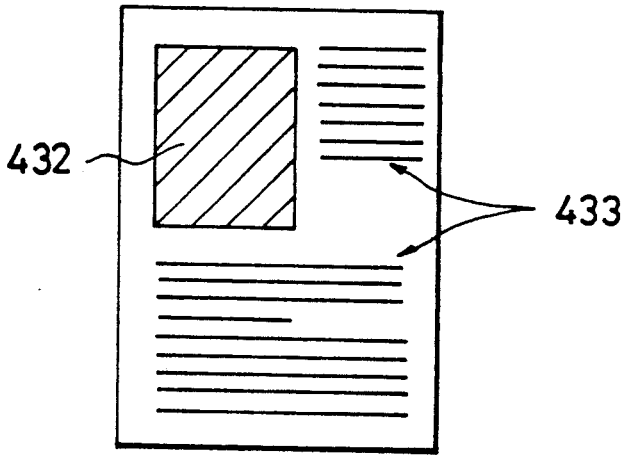
FIG. 11 is a view showing an example of an original having picture and character portions mixed each other.

As shown in FIG. 11, when an original having a picture portion 432 and a character portion 433 mixed with each other is used, one of the picture and character portions is designated by an editor, or both the picture and character portions are separated from each other at a reading time of a scanner. For example, the black developing container 308 is operated together with the other developing containers with respect to the picture portion. The black developing container 309 is operated together with the other developing containers with respect to the character portion. The developing operation is performed with respect to each of the picture and character portions. Finally, in this case, the five developing containers are sequentially operated.

In general, in the case of the monochromatic copy, the original image and an output image are mainly constructed by characters and diagrams. It is necessary to provide a sharp and high contrast for such an image. Namely, in the image forming apparatus of an electrophotographic type, it is preferable to use an image forming method having the so-called edge effect in the case of the monochromatic copy.

In contrast to this, in the case of the color copy, an image is constructed by a face image having a continuous gradation. Accordingly, it is necessary to provide a smooth and soft image restraining the edge effect. Namely, in this case, it is preferable to use an image forming method restraining the edge effect.

In the digital image forming apparatus, reproducibility of dots is improved by using the image forming method having the edge effect. However, when such an image forming method is used, the image quality is reduced by dispersions in shape and position of the dots, etc., thereby providing an image looking hard. Accordingly, the above reproducibility is reduced when a photographic original, an original having a picture, etc. are used.

Further, when a color copy image is obtained, there is a case in which a black portion of the color image is reproduced by the black toner without overlapping and transferring the yellow, magenta and cyan colors. Such reproduction is called a so-called inking-in operation. In the case of the inking-in operation, when the edge effect is increased at a developing time of the black toner, the black portion is excessively clear so that this black portion looks afloat and makes an impression different from that of the original image.

The features of the present invention are that the black developing container for a monochromatic image is constructed by a developing container for relatively increasing the edge effect with respect to the other developing containers.

For example, the respective developing containers 305 to 309 shown in FIG. 9 store carriers and developers of a two-component system having toners of the corresponding colors. The black developing container 309 for a monochromatic image stores a developer having carrier having a volume specific resistance higher than that of each of the carriers of the other developing containers. Concretely, the volume specific resistance of the carrier in the developing container 309 is set to about $10^{11}$ to $10^{12}$ Ωcm. In contrast to this, the other developing containers 305 to 308 respectively have carriers having a low volume specific resistance set to about $10^{6}$ Ωcm.

When a developer having the carrier of a low volume specific resistance is used, this carrier functions as a developing electrode so that it is possible to provide an image restraining the edge effect.

When the above developing operation is performed by using such developers having the carriers of low volume specific resistances and stored within the developing containers 305 to 308 for color, it is possible to obtain a smooth and soft face image having a continuous gradation and restraining the edge effect.

Further, in the digital image forming apparatus, no image looking hard is obtained, but an image having an intermediate gradation is preferably reproduced. As mentioned above, when the black portion of the color image is reproduced by the black toner without overlapping and transferring the yellow, magenta and cyan colors, the black portion tends to be excessively clear when the edge effect is increased at the developing time of the black toner. However, since the developer having the carrier of a low volume specific resistance is stored within the black developing container 308, the edge effect is restrained and it is possible to provide an image balanced with respect to the other colors.

In contrast to this, in the case of the monochromatic copy, there are many characters and diagrams so that the developing operation is performed by the black developing container 309 for the monochromatic copy storing the developer having the carrier of a high volume specific resistance. Accordingly, it is possible to provide an image having a sharp and high contrast and a high quality. When the image is constructed by an image having an intermediate gradation such as a photograph and a face image at the time of the monochromatic copy, it is possible to restrain the edge effect if the black developing container 8 is used, thereby preferably improving the reproducibility of the image.

There is a known developing device using a developing sleeve in which fine metal and carbon, etc. are dispersed and mixed with each other in a surface layer portion. The above edge effect can be increased when such a developing sleeve having a so-called floating electrode is used. Further, the edge effect can be also increased when such a developing sleeve is used in the black developing container 309 for a monochromatic copy. In contrast to this, it is sufficient to use a developing sleeve having a normal structure with respect to the other developing containers 305 to 308. In this case, a developer of one component having no carrier is used.

Figure 10:
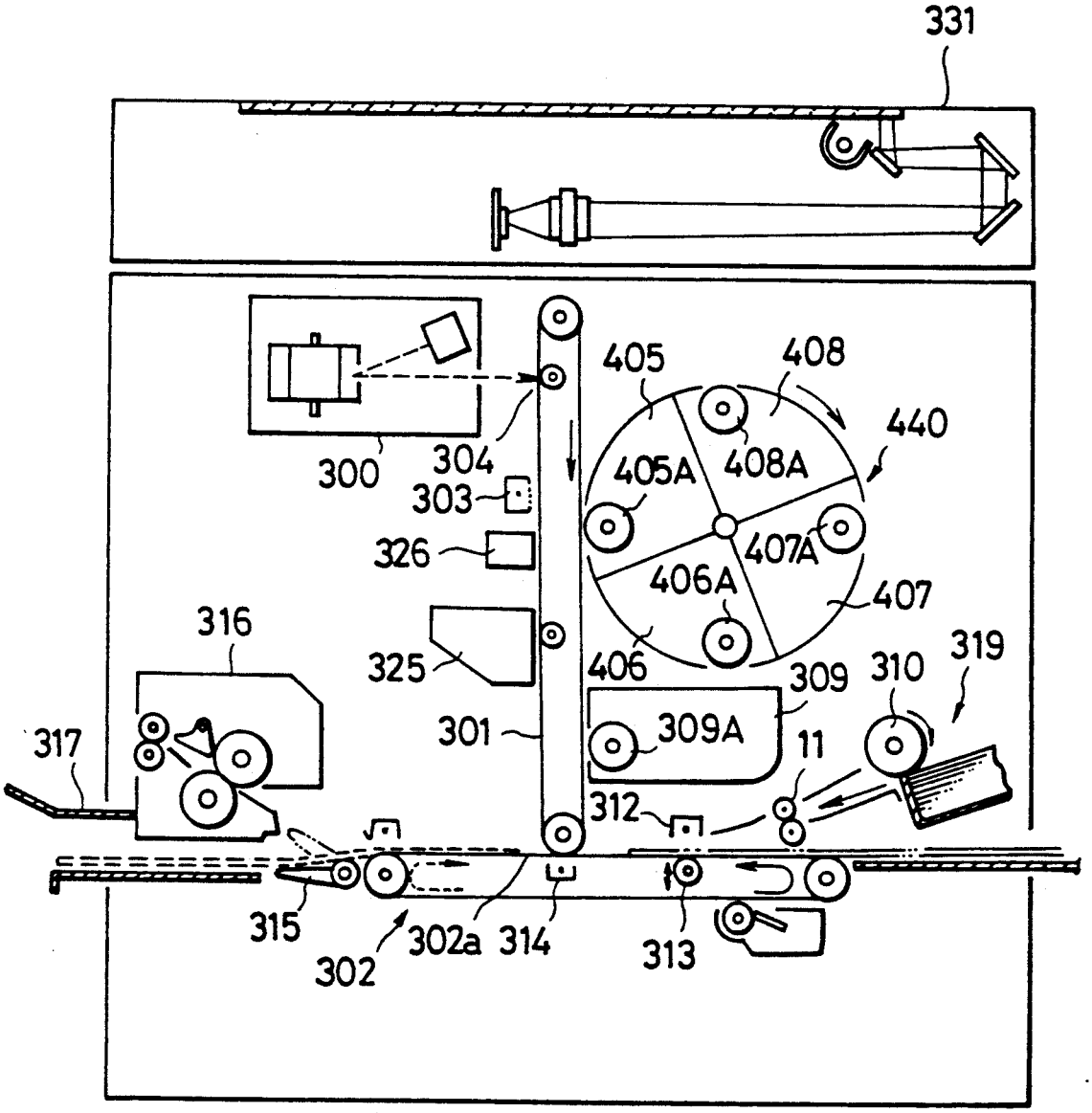
FIG. 10 is a schematic view showing the construction of an image forming apparatus in accordance with a fourth embodiment of the present invention.

As shown in FIG. 10, the developers 405 to 408 may be constructed by a developer of an integral type formed in the shape of a drum. The present invention can be also applied to an image forming apparatus having such a structure. Further, the present invention can be also applied to an image forming apparatus having a structure in which the photosensitive body 301 formed in the shape of a belt shown in FIG. 10 is changed to a photosensitive body 301 formed in the shape of a drum shown in FIG. 12.

In accordance with a first structure of the present invention, it is possible to provide a sharp image having the edge effect in the case of a monochromatic image mainly composed of characters and diagrams, etc. In the case of a color image, it is possible to provide a clear image having a good appearance and restraining the edge effect. Further, black toner for color for increasing the glossiness of a fixed image can be used in the black developing container for color. Toner for a monochromatic image for reducing the image glossiness can be used in the black developing container for the monochromatic image. Accordingly, it is possible to obtain an image having a quality suitable for each of the monochromatic and color images.

In accordance with a second structure of the present invention, it is possible to attain the above first object of the present invention by changing only developers without changing the construction of a developing device.

The construction of an image forming apparatus in a fourth embodiment of the present invention will next be described.

Figure 12:
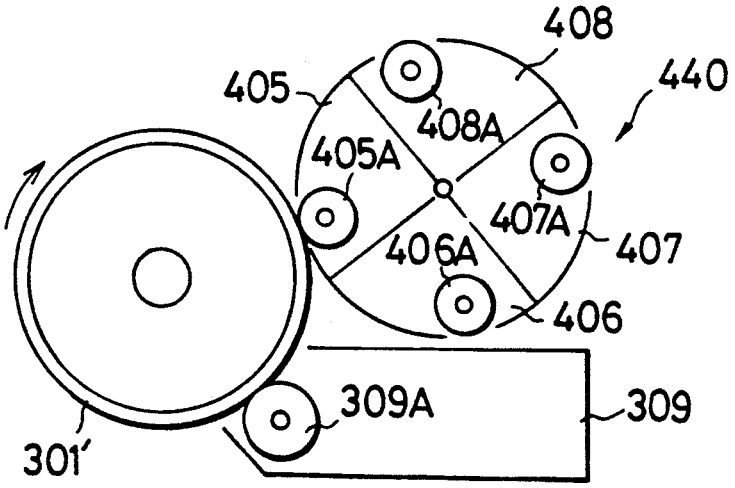
FIG. 12 is a schematic view showing the construction of an image forming apparatus in accordance with a fifth embodiment of the present invention.

The image forming apparatus in the fourth embodiment has a structure similar to that shown in each of FIGS. 9, 10 and 12. Namely, in FIG. 9, developing containers 305, 306, 307, 308 and 309 are respectively opposed to a photosensitive body 301. These developing containers are arranged along a moving direction of the photosensitive body 301. The developing containers 305 to 308 respectively store developers having colors different from each other. For example, these developers are constructed by developers having color toners composed of yellow, magenta, cyan, black toners, etc. Every time a developing operation is performed, an electrostatic latent image formed on the photosensitive body in advance is developed by each of the color toners as a toner image every color.

The developing containers 308 and 309 are respectively opposed to the photosensitive body 301 in addition to the plural developing containers 305 to 307 for developing the electrostatic latent image on the photosensitive body 301 by the respective toners having different colors except for black. Similar to the developing containers 305 to 307, the developing container 308 stores black toner for color used to increase the glossiness of a fixed image. The developer 309 stores black toner for a monochromatic image used to reduce the glossiness of a fixed image. In general, toner for increasing the glossiness of a fixed image has a low melting temperature when this toner is heated by a fixing device 316. In contrast to this, toner for decreasing the glossiness of a fixed image has a high melting temperature when this toner is heated by the fixing device 316. The black toner having such nature is used in each of the developing containers 308 and 309.

In general, a device for developing a latent image is mainly divided into a two-component developing system using a developer of a two-component system having carrier and toner and a one-component developing system using a developer of a one-component system having only toner and no carrier. In the one-component developing system, it is not necessary to separately dispose a portion for supplementing toner such as a toner cartridge and a means for mixing the toner and the carrier with each other. Accordingly, it is possible to make the entire developing device compact and light in weight in the one-component developing system.

In the fourth embodiment of the present invention, each of the developing containers 305 to 308 for color except for the black developing container 309 for a monochromatic image is constructed by a developing container storing the developer of a one-component system including no carrier. Thus, it is possible to make the respective developing containers compact and light in weight so that the entire image forming apparatus can be further made compact.

Different from the two-component developing system, it is possible to fill the developing containers with only the respective toners. In other words, a storing amount of each of the toners is increased in comparison with the two-component developing system. Accordingly, it is not necessary to often supplement the toners into the respective developing containers.

In a certain image forming apparatus having a plurality of developing containers around the photosensitive body, the respective developing containers are moved to developing and non-developing positions so as to prevent colors from being mixed with each other. In such an image forming apparatus, when the developers are made compact and light in weight, it is very advantageous to perform an operation of the image forming apparatus for moving the developers and it is very useful to make the entire image forming apparatus compact.

Further, it is not necessary to dispose a sensor for detecting the density of toner in each of the developers in comparison with the two-component developing system. Accordingly, it is possible to simplify the construction of the image forming apparatus, a control structure thereof, etc.

The one-component developing system is generally divided into two systems using magnetic and non-magnetic toners. The latter system using the non-magnetic toner is suitable for the formation of a color image since the non-magnetic toner has no magnetic material. It is possible to obtain a clearer lustered image by using the above-mentioned toners for color in addition to such non-magnetic toner.

In the case of the one-component developing system, no so-called spiked trace is easily caused at the developing time in comparison with the two-component developing system. Accordingly, it is possible to obtain a lustered color image having a uniform gradation and no spiked trace in an image portion having a large area.

In contrast to the one-component developing system having such features, an image can be formed at a high speed in the two-component developing system. Accordingly, it is possible to improve the reliability of a developed image in the two-component developing system.

In view of such points, in the present invention, the black developing container 309 for a monochromatic image is constructed by a developing container storing the developer of a two-component system having carrier and toner. Thus, it is possible to form an image at a high speed and stably obtain the image having a high quality. Further, it is possible to obtain an image easy to see and having a low glossiness by using black toner for only the monochromatic image as the above toner.

When a black-and-white image is normally formed, the black-and-white image is mainly constructed by characters, diagrams, etc. In a developing container for forming such a black-and-white image, high reliability in operation is required in view of frequency in use of this developing container. Further, it is necessary to develop an image at a high speed and easily maintain this developing container so as to improve productivity thereof. It is possible to satisfy such requirements by using the developing container storing the developer of a two-component system as the black developing container 309 for a monochromatic image.

It is also necessary to further make compact a developing container for obtaining a color image. It is also desirable to provide such a developing container for obtaining an image having a high quality. Such requirements can be satisfied by using a developing container storing a non-magnetic developer including no carrier as each of the developing containers 305 to 309 for color.

An image forming processing speed in the case of the formation of a monochromatic image is set to be higher than that in the case of the formation of a color image. For example, a driving speed of the photosensitive body 1 is set to be higher. Thus, it is possible to obtain a black-and-white image having a high quality with high productivity.

In FIG. 7, the respective developing containers are separately arranged. However, the developing containers 305 to 308 except for the black developing container 309 for a monochromatic image may be of an integral type and formed in the shape of a drum as shown in FIG. 10. In this example, a drum-shaped developer 340 is intermittently rotated every 90°. Developing sleeves 305A to 308A of the respective developing containers are sequentially rotated toward the same developing position A. In accordance with such a structure of the developing containers for color, it is possible to save a space for the developing containers so that the photosensitive body can be formed in the shape of a drum as shown by reference numeral 301 in in FIG. 12. Further, the black developing container 309A for a monochromatic image can be reduced in diameter by arranging this black developing container 309, etc. in the vicinity of the photosensitive body.

When developing positions of the developing containers are set to the same position, it is possible to stabilize a development processing condition and obtain a color image having a high quality without changing image forming processing conditions such as precharging and exposing conditions.

It is not necessary to form the developing containers for color in the shape of a drum. For example, these developing containers for color may be constructed such that the developing containers 305 to 308 shown in FIG. 9 can be moved in a vertical direction and are sequentially moved toward the same developing position. When the photosensitive body 301 is arranged in a horizontal direction, such developing containers can be moved in the same horizontal direction.

In accordance with the fourth embodiment of the present invention, it is possible to form a monochromatic image at a high speed and make the entire image forming apparatus compact. Further, it is possible to selectively obtain a monochromatic image easy to see and having a low glossiness and a clear color image having a high glossiness by using toners suitable for the monochromatic and color images in the respective developing containers.

Further, in the fourth embodiment of the present invention, since developing positions of the developing containers can be set to the same position, it is possible to obtain an image having a high quality without changing image forming processing conditions.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image forming apparatus comprising:

a plurality of color developing containers for developing an electrostatic latent image on a photosensitive body by toners having colors different from each other except for black;

a first black developing container for storing a first black developer for a color image, said first black developing container being operated when a developed image on said photosensitive body for every color is overlapped and transferred onto a transfer material to provide a color image;

a second black developing container for storing a second black developer for a monochromatic image, said second black developing container being operated when the monochromatic image is obtained; and means for arranging each of said color developing containers and said first black developing container such that each of said color developing containers and said first black developing container is opposite to said photosensitive body, a melting temperature of the first black developer being set to be lower then that of the second black developer.

2. An image forming apparatus according to claim 1, in which an image having no glossiness and easy to read is provided in a case of the monochromatic image, a glossy image having a good appearance is provided in a case of the color image.

3. An image informing apparatus according to claim 1, in which developing processings with respect to yellow, magenta, cyan and black colors are respectively performed in a same developing position of said photosentsitive body in a case of the color image.

4. An image forming apparatus comprising:

a plurality of color developing containers for developing an electrostatic latent image on a photosensitive body by toners having colors different from such other except for black;

a first black developing container for storing a first black developer for a color image, said first black developing container being operated when a developed image on said photosensitive body for every color is overlapped and transferred onto a transfer material to provide the color image;

a second black developing container for storing a second black developer for a monochromatic image, said second black developing container being operated when the monochromatic image is obtained; and means for arranging each of the color developing containers and said first black developing container such that each of said color developing containers and said first black developing container is opposite to said photosensitive body, glossiness of the monochromatic image developed by the second black developer being less than that of the color image developed by the first black developer.

5. An image forming apparatus according to claim 4, in which an image having glossiness less than that of the color image and easy to read is provided in a case of the monochromatic image, a bright image having glossiness greater than that of the monochromatic image is provided in a case of the color image.

6. An image forming apparatus according to claim 4, in which characters easy to read and clear pictures are provided on a same plane of the transfer material.

7. An image forming apparatus comprising:

a plurality of color developing containers for developing an electrostatic latent image on a photosensitive body by toners having colors different from each other except for black;

a first black developing container for storing a first black developer for a color image, the first black developer being composed of one component, said first black developing container being operated when a developed image on said photosensitive body for every color is overlapped and transferred onto a transfer material to provide the color image;

a second black developing container for storing a second black developer for a monochromatic image, the second black developer being composed of two components, said second black developing container being operated when the monochromatic image in obtained; and means for arranging each of said color developing containers and said first black developing container such that each of said color developing containers and said first black developing container is opposite to said photosensitive body.

8. An image forming apparatus according to claim 7, in which said first black developing container stores only toner and said second black developing container stores toner and carrier.

9. An image forming apparatus according to claim 7, in which said color developing containers and said first black developing container can be moved toward a same developing position of said photosensitive body.

10. An image forming apparatus comprising:

a plurality of color developing containers for developing an electrostatic latent image on a photosensitive body by toners having colors different from each other except for black;

a first black developing container for storing a first black developer for a color image, said first black developing container being operated when a developed image on said photosensitive body for every color is overlapped and transferred onto a transfer material to provide the color image;

a second black developing container for storing a second black developer for a monochromatic image, said second black developing container being operated when the monochromatic image is obtained; and means for arranging each of said color developing containers and said first black developing container such that each of said color developing containers and said first black developing container is opposite to said photosensitive body, the second black developer being composed of carrier of a resistance greater than that of each of carriers of said toners and said first black developer.

11. An image forming apparatus according to claim 10, in which said first black developing container and said color developing containers are formed in a shape of a drum.

* * * * *

UNITED STATES PATENT AND TRADEMARK OFFICE

CERTIFICATE OF CORRECTION

PATENT NO. : 5,160,969

DATED : November 3, 1992

INVENTOR(S) : Kenichi Mizuma et al.

It is certified that error appears in the above-identified patent and that said Letters Patent is hereby corrected as shown below:

On the title page, Item [63],

The Related U.S. Application Data is incorrect, should be,

--Continuation-in-part of Ser. No. 542,887, Jun. 25, 1990, abandoned--

Item [75],

The fifth inventor's first name is spelled incorrectly, should be,

--Shinji--

Signed and Sealed this

Sixteenth Day of March, 1993

*Attest:*

STEPHEN G. KUNIN

*Attesting Officer*

*Acting Commissioner of Patents and Trademarks*